US008900066B2

(12) United States Patent
Solheim et al.

(10) Patent No.: US 8,900,066 B2
(45) Date of Patent: Dec. 2, 2014

(54) ADJUSTABLE LENGTH GOLF CLUBS AND METHODS OF MANUFACTURING ADJUSTABLE LENGTH GOLF CLUBS

(71) Applicant: Karsten Manufacturing Corporation, Phoenix, AZ (US)

(72) Inventors: John A. Solheim, Anthem, AZ (US); Brandon L. Fossum, Phoenix, AZ (US); Marty R. Jertson, Phoenix, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/908,347

(22) Filed: Jun. 3, 2013

(65) Prior Publication Data

US 2013/0267343 A1 Oct. 10, 2013

Related U.S. Application Data

(63) Continuation of application No. 13/658,327, filed on Oct. 23, 2012, now Pat. No. 8,496,539, which is a continuation-in-part of application No. 13/604,032, filed on Sep. 5, 2012, now Pat. No. 8,419,564.

(60) Provisional application No. 61/553,817, filed on Oct. 31, 2011, provisional application No. 61/596,938, filed on Feb. 9, 2012, provisional application No. 61/606,158, filed on Mar. 2, 2012, provisional application No. 61/612,050, filed on Mar. 16, 2012, provisional application No. 61/613,920, filed on Mar. 21, 2012, provisional application No. 61/615,806, filed on Mar. 26, 2012, provisional application No. 61/641,208, filed on May 1, 2012.

(51) Int. Cl.
*A63B 53/16* (2006.01)
*B25G 3/24* (2006.01)

(52) U.S. Cl.
USPC ..... 473/296; 403/290

(58) Field of Classification Search
USPC ..... 473/294, 298–299, 296, 239; 403/344, 403/290, 374.3, 338; 279/43.3, 2.02, 4.07
See application file for complete search history.

(56) References Cited

U.S. PATENT DOCUMENTS

| | | | | |
|---|---|---|---|---|
| 2,002,108 | A * | 5/1935 | Child | 473/239 |
| 3,473,202 | A * | 10/1969 | Howard | 403/344 |
| 5,513,845 | A * | 5/1996 | Sonagere | 473/206 |
| 6,071,199 | A * | 6/2000 | Suzuki | 473/294 |
| 6,413,006 | B1 * | 7/2002 | Neugart | 403/344 |
| 6,557,878 | B2 * | 5/2003 | Chen | 280/226.1 |
| 6,896,438 | B1 * | 5/2005 | Chen | 403/290 |
| 7,074,135 | B2 * | 7/2006 | Moore | 473/296 |
| 7,252,598 | B2 * | 8/2007 | Lindner | 473/320 |
| 7,658,683 | B1 * | 2/2010 | Daniel | 473/294 |
| 8,075,217 | B2 * | 12/2011 | Eason | 403/109.1 |
| 2003/0083144 | A1 * | 5/2003 | Shin | 473/296 |

* cited by examiner

*Primary Examiner* — Stephen L. Blau

(57) ABSTRACT

Embodiments of adjustable length golf clubs and methods of manufacturing adjustable length golf clubs are generally described herein. Other embodiments may be described and claimed.

23 Claims, 13 Drawing Sheets

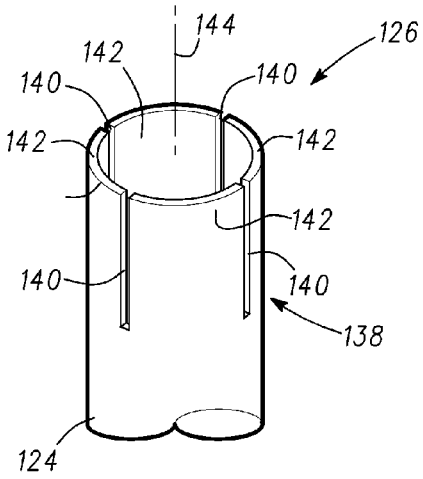
Fig. 11
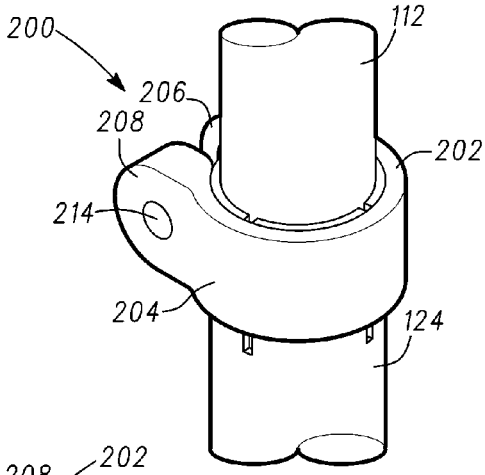
Fig. 12
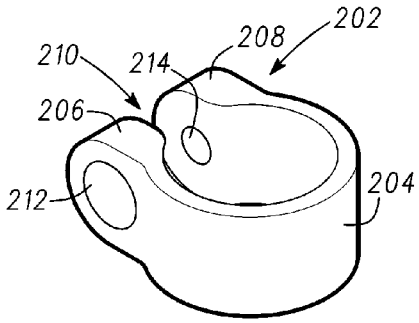
Fig. 13
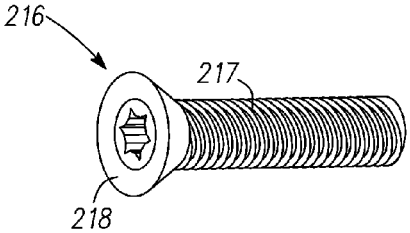
Fig. 14
Fig. 15
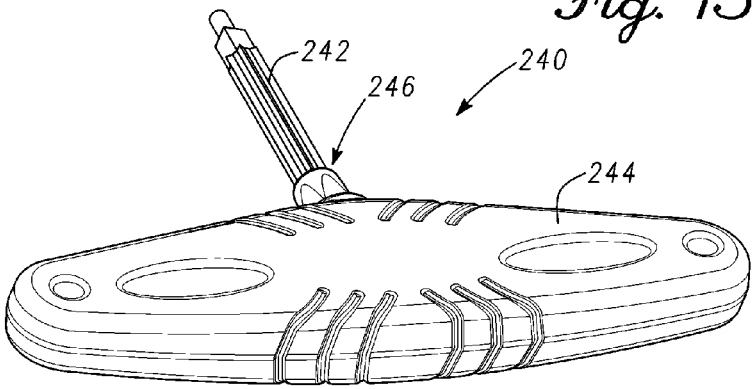

ADJUSTABLE LENGTH GOLF CLUBS AND METHODS OF MANUFACTURING ADJUSTABLE LENGTH GOLF CLUBS

CROSS REFERENCE

The present application is a continuation of U.S. patent application Ser. No. 13/658,327, filed on Oct. 23, 2012, which is a continuation-in-part of U.S. patent application Ser. No. 13/604,032, filed on Sep. 5, 2012, which claims the benefit of the filing dates of U.S. Provisional Application Ser. No. 61/553,817, filed Oct. 31, 2011; U.S. Provisional Application Ser. No. 61/596,938, filed Feb. 9, 2012; U.S. Provisional Application Ser. No. 61/606,158, filed Mar. 2, 2012; U.S. Provisional Application Ser. No. 61/612,050, filed Mar. 16, 2012; U.S. Provisional Application Ser. No. 61/613,920, filed Mar. 21, 2012; U.S. Provisional Application Ser. No. 61/615,806, filed Mar. 26, 2012; and U.S. Provisional Application Ser. No. 61/641,208, filed May 1, 2012. The present application also claims the benefit of the filing dates of U.S. Provisional Application Ser. No. 61/553,817, filed Oct. 31, 2011; U.S. Provisional Application Ser. No. 61/596,938, filed Feb. 9, 2012; U.S. Provisional Application Ser. No. 61/606,158, filed Mar. 2, 2012; U.S. Provisional Application Ser. No. 61/612,050, filed Mar. 16, 2012; U.S. Provisional Application Ser. No. 61/613,920, filed Mar. 21, 2012; U.S. Provisional Application Ser. No. 61/615,806, filed Mar. 26, 2012; and U.S. Provisional Application Ser. No. 61/641,208, filed May 1, 2012. All of the above listed applications are expressly incorporated herein by reference.

FIELD

The present application generally relates to golf clubs, and more particularly, to adjustable length golf clubs and methods of manufacturing adjustable length golf clubs.

BACKGROUND

Golf clubs may be fitted to an individual based on the type of golf club, the individual's physical characteristics and/or the individual's play style. For example, an individual may wish to play with a regular putter, a long putter or a belly putter. Depending on the individual's physical characteristics and play style, an appropriate fixed length for the putter may be determined to provide optimum performance for the individual. Accordingly, a putter may be selected by an individual in the appropriate fixed length.

BRIEF DESCRIPTION OF THE DRAWINGS

FIG. 11 shows a section of the shaft of an adjustable length golf club according to one embodiment.

FIG. 12 shows a locking mechanism for an adjustable length golf club according to one embodiment.

FIG. 13 shows a collar for the locking mechanism of FIG. 12.

FIG. 14 is a fastener for a locking mechanism of an adjustable length golf club according to one embodiment.

FIG. 15 is a tool for operating the fastener of FIG. 14.

DESCRIPTION

Figure 1:
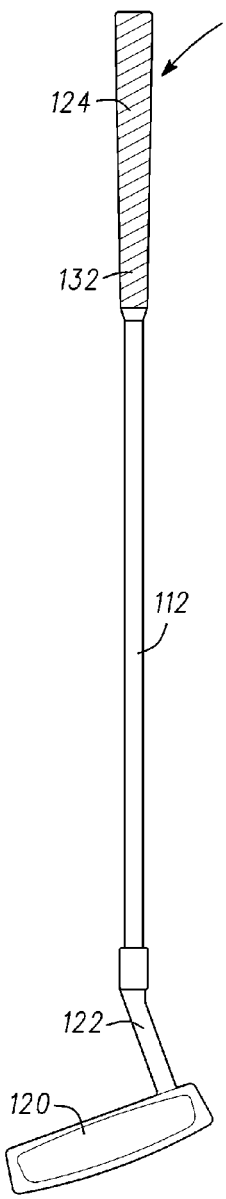
FIG. 1 shows an adjustable length golf club according to one embodiment.
Figure 2:
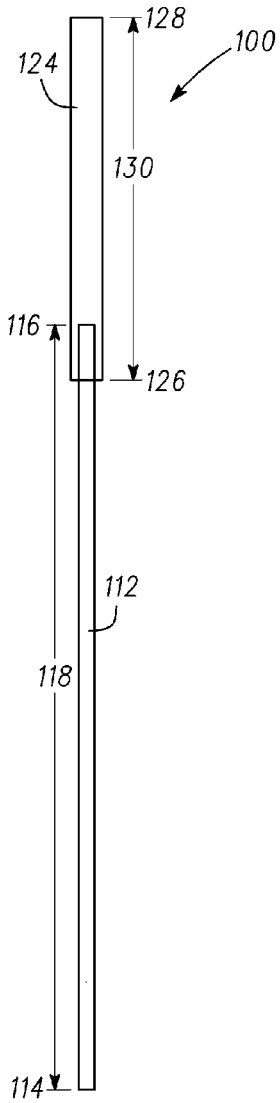
FIG. 2 shows a schematic diagram of the golf club of FIG. 1.
Figure 3:
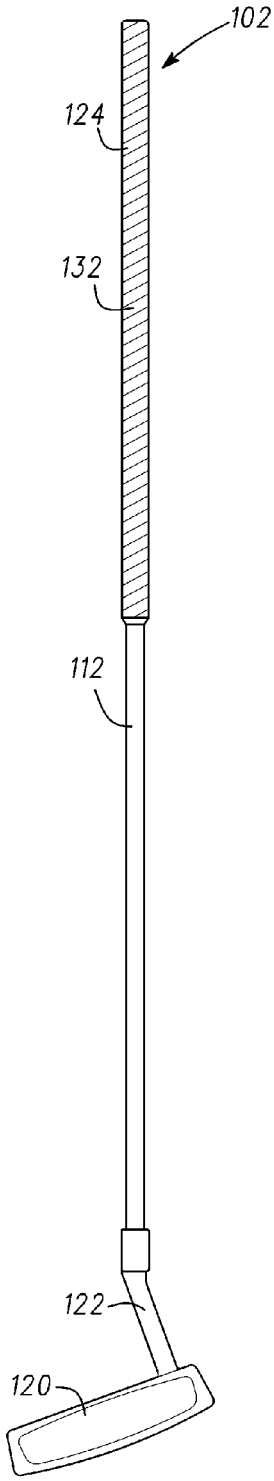
FIG. 3 shows an adjustable length golf club according to another embodiment.
Figure 4:
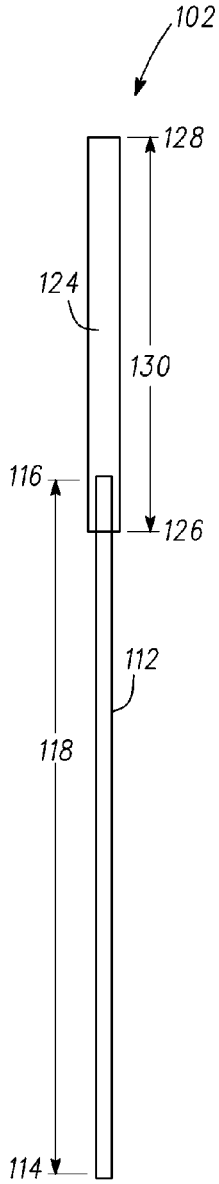
FIG. 4 shows a schematic diagram of the golf club of FIG. 3.
Figure 5:
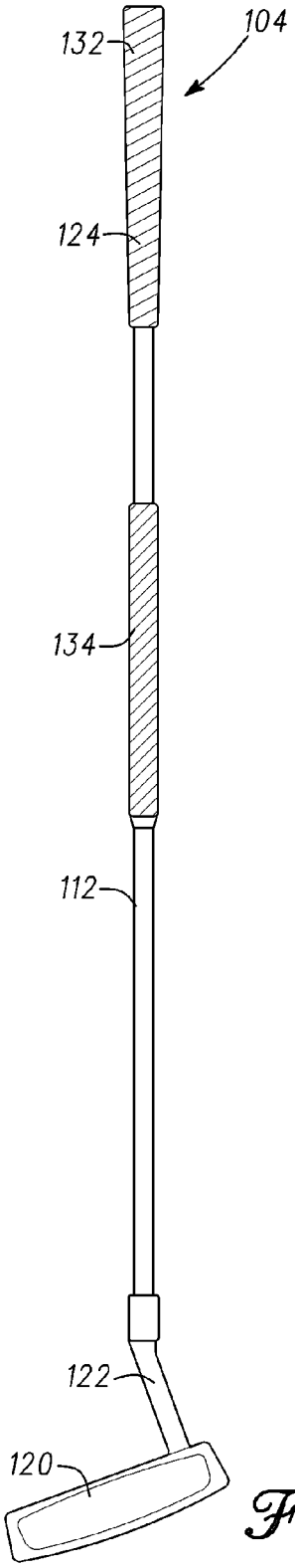
FIG. 5 shows an adjustable length golf club according to another embodiment.
Figure 6:
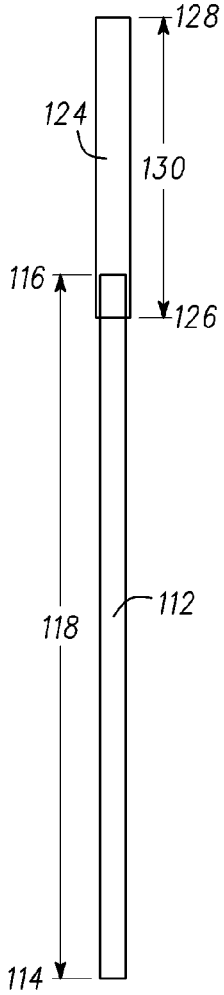
FIG. 6 shows a schematic diagram of the golf club of FIG. 5.

Referring to FIGS. 1, 3 and 5, three example adjustable length golf clubs 100, 102 and 104 according to the disclosure are shown. As described in detail below, the golf club 100 is an example of a "standard" putter, the golf club 102 is an example of a "belly" putter, the golf club 104 is an example of a "long" putter. In general, the golf club 100 may be relatively shorter in length than both of the golf clubs 102 and 104. The golf club 104 may be relatively longer in length than both of the golf clubs 100 and 102. The golf club 102 may be relatively longer in length than the golf club 100 but shorter in length than the golf club 104. Referring also to FIGS. 2, 4 and 6, each of the golf clubs 100, 102 and 104 includes a first shaft 112 with a first end 114 and a second end 116 defining a first length 118, and a club head 120 having a hosel 122 for connecting to the first end 114 of the first shaft 112. Each of the golf clubs 100, 102 and 104 further includes a second shaft 124 having a first end 126 and a second end 128 defining a second length 130. A grip 132 may be located on the second shaft 124. The belly putter 102 may include a longer first shaft 112 and/or a longer second shaft 124. Referring to FIG. 5, another grip 134 may be provided for the long putter 104. The grip 134 may be located on the first shaft 112. The long putter 104 may also include a longer second shaft 124 as compared to the standard putter 100. The long putter 104 may also include a longer first shaft 112. The disclosure is not limited to putters and is applicable to any type of golf club (e.g., a driver-type club head, a fairway wood-type club head, a hybrid-type club head, an iron-type club head, a wedge-type club head, or other types of putter-type club heads).

The first shaft 112 may be hollow and have a portion with a larger inner diameter than an outer diameter of a portion of the second shaft 124 to moveably accommodate the second shaft 124 therein. Alternatively, the second shaft 124 may be hollow and have a portion with a larger inner diameter than an outer diameter of a portion of the first shaft 112 to moveably accommodate the first shaft 112 therein. As shown in the example of FIGS. 2 and 4, for the standard putter 100 and the belly putter 102, the second shaft 124 may be hollow and have an inner diameter that is slightly larger than an outer diameter of the first shaft 112 so as to moveably receive the first shaft 112 therein. In contrast, as shown in the example of FIG. 6, for the long putter 104, the first shaft 112 may be hollow and have an inner diameter that is slightly larger than an outer diameter of the second shaft 124 so as to moveably receive the second shaft 124 therein. In the following examples, the first shaft 112 is described as being insertable and moveable within the second shaft 124. However, as described above, a golf club according to the disclosure may include a first shaft 112 that is insertable and movable within the second shaft 124, such as in the case of the long putter 104. The apparatus, methods, and articles of manufacture described herein are not limited in this regard.

Figure 7:
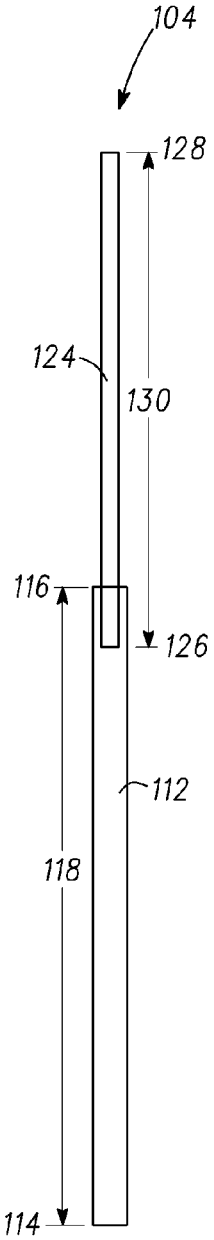
FIG. 7 shows a schematic diagram of an adjustable length golf club according to another embodiment.
Figure 8:
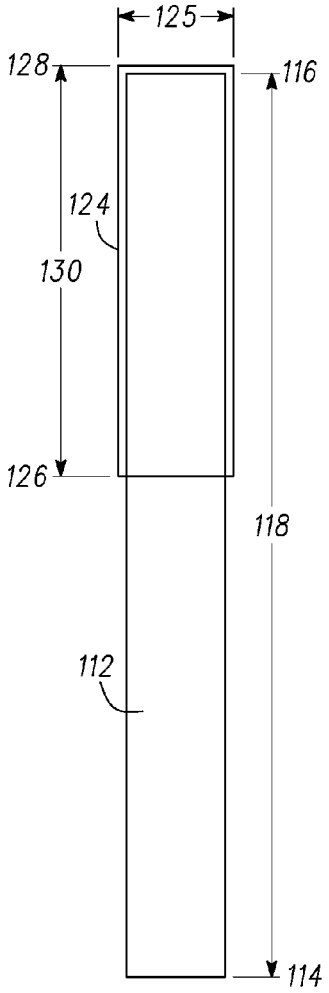
FIGS. 8-10 show schematic diagrams of adjustable length golf clubs according to various embodiments.
Figure 9:
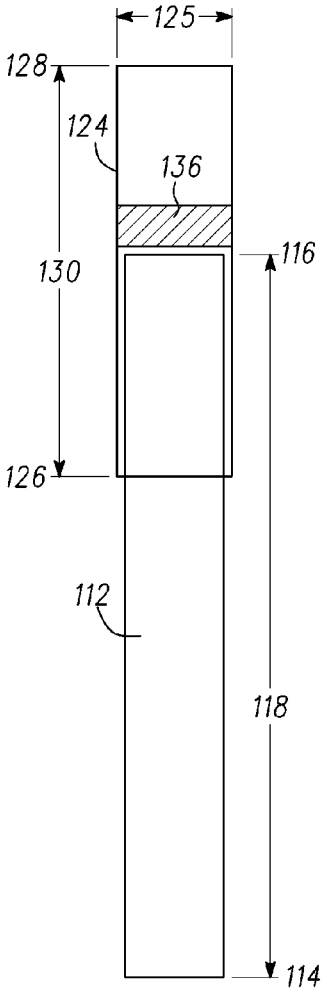
Figure 10:
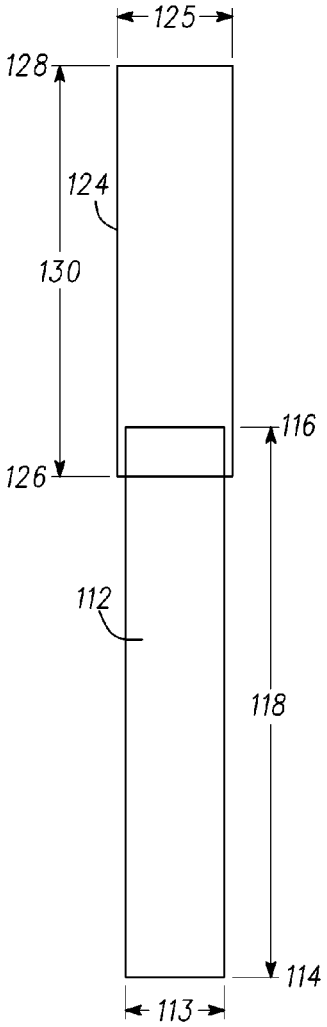

Referring to FIGS. 7-10, the second shaft 124 may be hollow and have an inner diameter 125 (shown in FIGS. 8-10). The second end 116 of the first shaft 112 has an outer diameter 113 (shown in FIG. 10) that is slightly smaller than the inner diameter 125 of the second shaft 124 so that the second end 116 of the first shaft 112 may be inserted into the second shaft 124 from the first end 126 of the second shaft 124. Accordingly a total length L of the golf club 100, 102 or 104 is adjustable within a range approximately defined by the following relation:

$$L \approx L1 + L2 + LH - LI$$

Where L1 denotes the first length 118, L2 denotes the second length 130, LH is the length of the club head 120 including the hosel 122, and LI is the length of the first shaft 112 that is inserted into the second shaft 124. LI can be defined as:

$$LI_{max} \geq LI \geq LI_{min}$$

Where $LI_{max}$ is the largest portion of the first shaft 112 that can be inserted into the second shaft 124, and $LI_{min}$ is the smallest portion of the first shaft 112 that can be inserted into the second shaft 124. Thus, $LI_{max}$ may correspond to the shortest total length of the entire golf club 100, 102 or 104, and $LI_{min}$ may correspond to the longest total length of the entire golf club 100, 102 or 104.

According to one example shown in FIG. 8, the entire second shaft 124 may be hollow and/or without any obstructions therein such that the first shaft 112 can be inserted therein until the second end 116 of the first shaft 112 reaches the first end 126 of the second shaft 124. In this example, $LI_{max}$ is approximately equal to L2 and the shortest total length L of the golf club 100, 102 or 104 can be defined as L≈L1+LH. Thus, the shortest length L of the golf club 100, 102 or 104 may be approximately L1+LH.

According to another example shown in FIG. 9, either only a portion of the second shaft 124 may be hollow or the second shaft 124 may include a stop 136 therein. Accordingly, the first shaft 112 can be inserted in the second shaft 124 until the second end 116 of the first shaft 112 contacts the stop 136. Thus, $LI_{max}$ may be defined in this example by the distance from the stop 136 to the first end 126 of the second shaft 124, and the smallest total length L may be defined as L≈L1+L2+LH−$LI_{max}$. In another example, a stop (not shown) may be placed on the outer surface of the first shaft 112 instead of inside the second shaft 124. Such a stop may engage the first end 126 of the second shaft 124 to prevent further insertion of the first shaft 112 into the second shaft 124.

According to another example shown in FIG. 10, the largest total length L that may be achievable by the golf club 100, 102 or 104 occurs when LI is approximately equal to $LI_{min}$. If LI is less than $LI_{min}$, a locking of the first shaft 112 and the second shaft 124 together as described in detail below may not be possible. Thus, according to the example of FIG. 10, the largest total length L may be defined as L≈L1+L2+LH−$LI_{min}$.

Referring to FIG. 11, the second shaft 124 includes proximate to the first end 126 an end portion 138 configured to be pressed against the first shaft 112 to frictionally engage the first shaft 112 to prevent movement between the first shaft 112 and the second shaft 124. The end portion 138 may be flexible so as to provide compression thereof against the first shaft 112. For example, the end portion 138 may comprise a flexible bushing, spring, or like structures that exhibit flexibility and/or elasticity. In the example of FIG. 11, the end portion 138 includes one or more slits 140 that extend from the first end 126 toward the second end 128. In the example of FIG. 11, the end portion 138 includes four slits 140 that divide the end portion 138 into four generally similar cantilever leaves 142. Each leaf 142 is bendable toward a center axis 144 of the second shaft 124. The end portion 138 may have any number of slits 140. For example, the end portion 138 may include only one slit. The slits 140 may be linear, non-linear, continuous, discontinuous or have any shape, size and/or configuration so long as the flexibility and/or elasticity of the end portion 138 according to the disclosure is provided. The slits 140 represent one example of having the end portion 138 configured to press against the first shaft 112. Accordingly, an end portion 138 having other configurations as possible. For example, the end portion 138 may be constructed from a flexible and/or elastic material to provide compression against the first shaft 112 to frictionally engage the first shaft 112. The apparatus, methods, and articles of manufacture described herein are not limited in this regard.

The first shaft 112 may include markings (not shown) to visually assist the player during the length adjustment process. For example, the first shaft 112 may include lines, dots, tick marks or the like that are equally spaced apart along the length of the first shaft 112. Some or all of the lines may include numbers that represent actual distance from the line to the second shaft 124 or represent the overall length of the golf club 100, the golf club 102 and/or the golf club 104.

Because the inner surfaces of the second shaft 124 rub against the outer surfaces of the first shaft 112 during the above-described length adjustment, the outer surface of the first shaft 112 may be cosmetically damaged. The second shaft 124 may include a bushing or other type of reduced-friction pad (not shown) along the inner surface of the end portion 138 to prevent cosmetic damage to the outer surface of the first shaft 112. The bushing may also facilitate smoother and easier sliding of the first shaft 112 relative to the second shaft 124 during a length adjustment. For example, the bushing may be manufactured from a low friction material such as Teflon® to facilitate a more effortless sliding motion between the first shaft 112 and the second shaft 124 during adjustment of the putter length. However, any material can be used for the bushing. Alternatively, the outer surface of the second shaft 124 may have a rough or blasted finish so as to hide any cosmetic damages that may be caused by the sliding motion between the first shaft 112 and the second shaft 124. In one example, to reduce or prevent abrasion and cosmetic damage, the material from which at least a portion of the first shaft 112 that is in contact with the second shaft 124 is constructed may have a different hardness than the material from which at least a portion of the second shaft 124 that is in contact with the first shaft 112 is constructed. For example, the first shaft 112 may be constructed from a metal and the second shaft 124 may be constructed from graphite. Accordingly, slidable movement of the first shaft 112 and the second shaft 124 may not cosmetically damage the first shaft 112 and/or the second shaft 124.

Any of the golf clubs 100, 102 or 104 may include a locking mechanism to prevent movement between the first shaft 112 and the second shaft 124 or to fix the length of the golf club 100 after the length is adjusted by an individual. In the following, several locking mechanism examples are described with respect to the golf club 100. However, the disclosed locking mechanisms are similarly applicable to golf clubs 102 and/or 104. Furthermore, a locking mechanism according to the disclosure is not limited to the following examples. The apparatus, methods, and articles of manufacture described herein are not limited in this regard.

Referring to FIGS. 12 and 13, a locking mechanism 200 according to one example is shown. The locking mechanism 200 includes a clamp or collar 202 (hereinafter referred to as collar 202) that is generally positioned around the first end 126 of the second shaft 124. The collar 202 includes a C-shaped section 204 and a pair of opposing flanges 206 and 208 defining a gap 210 of the C-shaped section 204. Each flange 206 and 208 has an aperture 212 and 214, respectively, for receiving a fastener. In the example of FIGS. 12 and 13, a fastener such as a bolt 216 (shown in FIG. 14) may be used with the collar 202. The inner wall of at least one of the apertures 212 or 214 may be threaded to engage corresponding threads on a shaft 217 of the bolt 216. In the example of FIG. 13, the aperture 214 is threaded to receive the shaft 217 of the bolt 216, and the aperture 212 is wider than aperture 214 to receive a head 218 (shown in FIG. 14) of the bolt 216. The bolt 216 may be a Torx bolt having a Torx head 218. However, the bolt 216 may be any type of threaded bolt and may have any type of head for receiving a corresponding type of tool such as an Allen® wrench, a flat-head screwdriver, a Phillips-head screwdriver, a hex head for receiving a hex wrench, or other types of tools. The apparatus, methods, and articles of manufacture described herein are not limited in this regard.

Moving the flanges 206 and 208 toward each other shrinks the gap 210, thereby compressing the collar 202 to reduce the inner diameter of the collar 202. To compress the collar 202, the bolt 216 may be tightened, which causes the shaft 217 of the bolt 216 to advance through the threaded aperture 214, thereby causing the flanges 206 and 208 to move toward each other. Compressing the collar 202 causes the leaves 142 to press against the first shaft 112 (i.e., moves the leaves 142 toward the center axis 144) to frictionally lock the first shaft 112 to the second shaft 124. The outer diameter 113 and the inner diameter 125 are such that the first shaft 112 slides within the second shaft 124. In other words, the outer surfaces of the first shaft 112 may contact the inner surface of the second shaft 124. Accordingly, tightening of the bolt 216 to frictionally lock the first shaft 112 inside the second shaft 124 may be accomplished rapidly as the bolt 216 may not require a large number of turns to sufficiently compress the collar 202 around the leaves 142. According to the disclosure, frictional lock may be defined as the first shaft 112 and the second shaft 124 remaining secured to each other during normal operating use of the golf club 100, i.e., playing golf. Accordingly, when the first shaft 112 and the second shaft 124 are frictionally locked, applying forces on the golf club 100 that fall beyond a range of forces encountered by the golf club 100 during play may cause the first shaft 112 and the second shaft 124 to slip relative to each other and change the length of the golf club 100.

When the bolt 216 is loosened, the elastic restoring force of the collar 202 biases the collar 202 toward the generally uncompressed configuration of the collar 202 to widen the gap 210. Accordingly, when the bolt 216 is sufficiently loosened, an individual can move the first shaft 112 and the second shaft 124 relative to each other to adjust the length of the golf club. However, the collar 202 may exert a compressive force on the leaves 142, thereby causing sufficient frictional engagement between the leaves 142 and the first shaft 112 to prevent free movement of the first shaft 112 relative to the second shaft 124. As a result, the first shaft 112 and the second shaft 124 may maintain their relative translational and rotational positions until an individual physically adjusts the length of the golf club 100.

Referring to FIG. 15, the golf club 100 may include a tool 240 by which the bolt 216 can be tightened or loosened. The golf club 100 and the tool 240 may be provided as a package or a kit. The tool 240 may include a tip 242 and a handle 244. The tip 242 may be compatible with the head 218 of the bolt 216 and correspond in shape and size to the head 218 of the bolt 216. An individual can use the tip 242 to engage the bolt 216. Then, turning the handle 244 in one direction tightens the bolt 216 and turning the handle 244 in the opposite direction loosens the bolt 216. To secure the first shaft 112 to the second shaft 124 with the locking mechanism 200, a torque of 30-50 in-lbs. may be applied to the bolt 216. To prevent an individual from applying excessive torque to the bolt 216, the tool 240 may be a torque limiting tool. For example, the tip 242 and the handle 244 may be connected at a torque limiting joint 246. When a torque of greater than a predetermined torque is applied to the handle 244, the joint 246 may slip or ratchet to prevent the excessive torque from being transferred to the tip 242. Accordingly, the tool 240 with a torque limiting feature prevents the application of excessive torque on the bolt 216, thereby preventing damage to the locking mechanism 200 and/or the first shaft 112 and/or the second shaft 124. The apparatus, methods, and articles of manufacture described herein are not limited in this regard.

Figure 16:
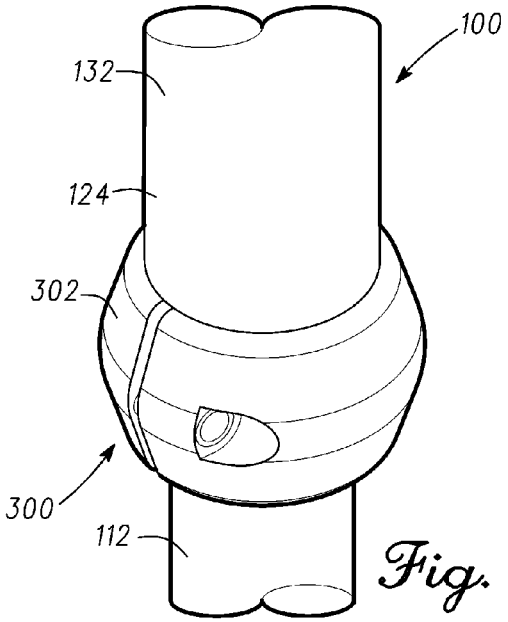
FIG. 16 shows a locking mechanism for an adjustable length golf club according to another embodiment.
Figure 17:
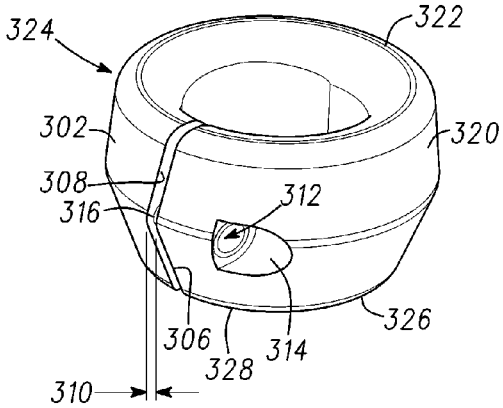
FIG. 17 shows a collar for the locking mechanism of FIG. 16.
Figure 18:
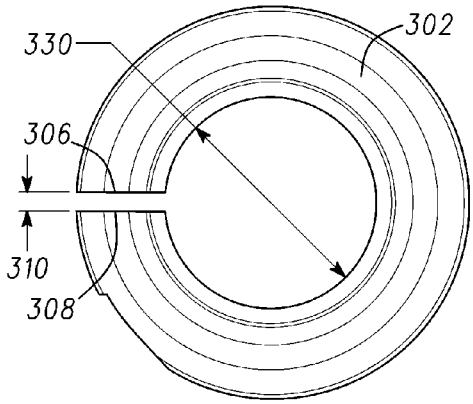
FIGS. 18-19 show a collar for the locking mechanism of FIG. 16 according to another embodiment.
Figure 19:
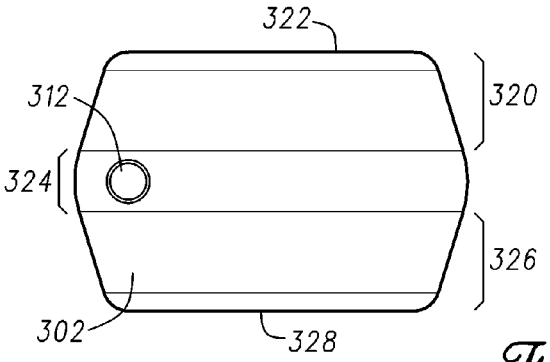

Referring to FIG. 16, the golf club 100 is shown having another exemplary locking mechanism 300. The locking mechanism 300 includes a collar 302 that may be positioned around the first end 126 of the second shaft 124. Referring to FIGS. 17-19, the collar 302 is C-shaped and includes a first inner surface 306 and a second inner surface 308 defining a gap 310. One side of the collar 302 includes a bore 312 that extends from a first opening 314 toward the gap 310 to define a second opening 316 in the first inner surface 306. The second opening 316 faces the second inner surface 308. The bore 312 may be configured to receive a correspondingly sized fastener. For example, the bore 312 may be threaded to engage corresponding threads on the bolt 216 of FIG. 14. A tool, such as the tool 240 of FIG. 15 may be used to turn the bolt 216 to advance the bolt 216 through the bore 312 or withdraw the bolt 216 from of the bore 312.

The collar 302 may be cylindrical, partially tapered and/or fully tapered. Referring to FIGS. 16 and 17, the collar 302 includes a first section 320 that is tapered from a first end 322 to a transition portion 324 and a second section 326 that is tapered from the transition portion 324 toward the second end 328. The first section 320 and the second section 326 may be similarly and/or symmetrically tapered as shown in the example of FIG. 19. As shown in the example of FIG. 17, however, the second section 326 may be more steeply tapered than the first section 320. The tapered configuration may provide a reduction in weight for the collar 302 as compared to a generally cylindrical-shaped collar. Additionally, the tapered configuration may provide an aesthetically pleasing and/or a visually continuous transition on the golf club 100 between the first shaft 112 and the second shaft 124. Alternatively, the collar 302 may be cylindrical without having any taper. The transition portion 324 may be generally located at the center of the collar 302. However, the transition portion 324 may be located anywhere between the first and 322 and the second end 328. As shown in the examples of FIGS. 16-19, the bore 312 may be located at a generally thicker portion of the collar 302 so as to provide sufficient thickness and strength for accommodating a fastener and the forces associated with compressing and/or uncompressing the collar 302 by operating a fastener. For example, the bore 312 shown in the examples of FIGS. 16-18 is located in the transition portion 324, which may be a thicker portion of the collar 302.

Referring to FIG. 18, the collar 302 has an inner diameter 330 in an unexpanded and uncompressed configuration that is smaller than the outer diameter 113 of the second shaft 124. In other words, when the collar 302 is at rest and no forces are acting on the collar 302, the inner diameter 330 is smaller than the outer diameter 113 of the second shaft 124. The difference between the inner diameter 330 of the collar 302 and the outer diameter 113 may be such that when the collar 302 is placed over the leaves 142, the frictional engagement between the leaves 142 and the first shaft 112 is sufficient to frictionally lock the first shaft 112 to the second shaft 124, i.e., to lock the locking mechanism 300.

To allow the first shaft 112 and the second shaft 124 to move relative to each other, i.e., to unlock the locking mechanism 300, an individual can expand the collar 302 to increase the inner diameter 330. Thus, the collar 302 provides a default locking of the first shaft 112 to the second shaft 124 when located at the first and 126 of the second shaft 124 and over the leaves 142. Sufficient expansion of the collar 302 can relieve the compression force on the leaves 142 to allow the first shaft 112 and the second shaft 124 to move relative to each other to provide adjustability of the length of the golf club 100. To expand the collar 302 from an unexpanded state, a fastener may be used, such as the bolt 216 or the exemplary bolts described in detail below may be used.

Figure 20:
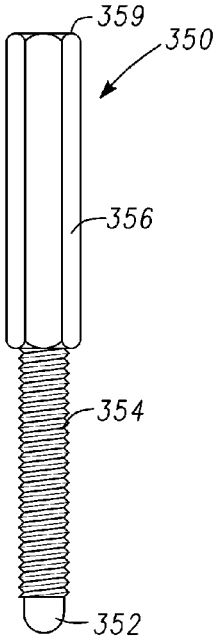
FIG. 20 shows a fastener for a locking mechanism of an adjustable length golf club according to another embodiment.
Figure 21:
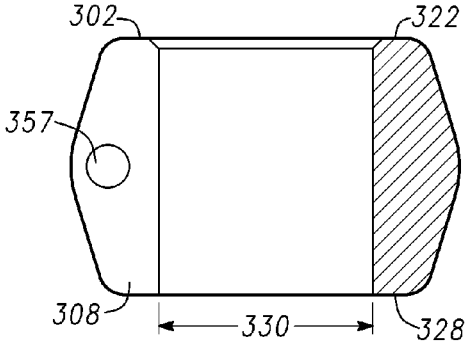
FIG. 21 shows the collar for the locking mechanism of FIG. 16 according to another embodiment.

Referring to FIG. 20, a bolt 350 according to another example is shown. The bolt 350 includes a tip portion 352, a threaded shaft 354 and a head 356. The threads on the shaft 354 are configured to engage the threads in the bore 312 of the collar 302. To prevent possible stripping of the threads on the shaft 354 near the tip portion 352 when the tip portion 352 engages the second inner surface 308, the tip portion 352 may be unthreaded and/or rounded as shown in FIG. 20. The tip portion 352 provides a space between the shaft 354 and the second inner surface 308 to prevent damage to the threads on the shaft 354 when the bolt 350 contacts the second inner surface 308 and is turned relative to the second inner surface 308. The tip portion 352 may also serve as a guide when the bolt 350 is inserted into the bore 312 to prevent stripping of the threads on the shaft 354 when the threads on the shaft 354 initially engage the threads in the bore 312. Accordingly, the tip portion 352 initially enters into the bore 312 to allow the threads on the shaft 354 and the threads in the bore 312 to properly engage. Referring to FIG. 21, the second inner surface 308 of the collar 302 may include a depression or a dimple 357 that is configured to receive the rounded tip portion 352 of the bolt 350. The dimple 357 and/or the tip portion 352 may be coated with reduced friction materials to provide reduced frictional engagement between the tip portion 352 and the dimple 357. The head 356 is configured to allow engagement thereof with a correspondingly configured tool as described in detail below. For example, the head 356 may be hex shaped as shown in FIG. 20. However, the shape of the head 356 is not limited and can be in any shape to allow engagement thereof with a correspondingly configured tool.

Figure 24:
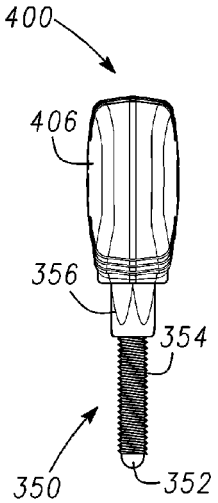
FIGS. 22-24 show a tool and the fastener of FIG. 24 of a locking mechanism of an adjustable length golf club according to another embodiment.
Figure 22:
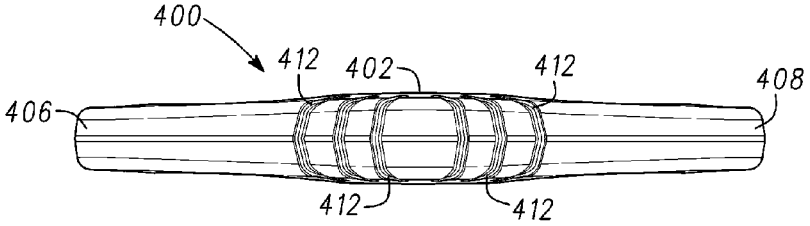
Figure 23:
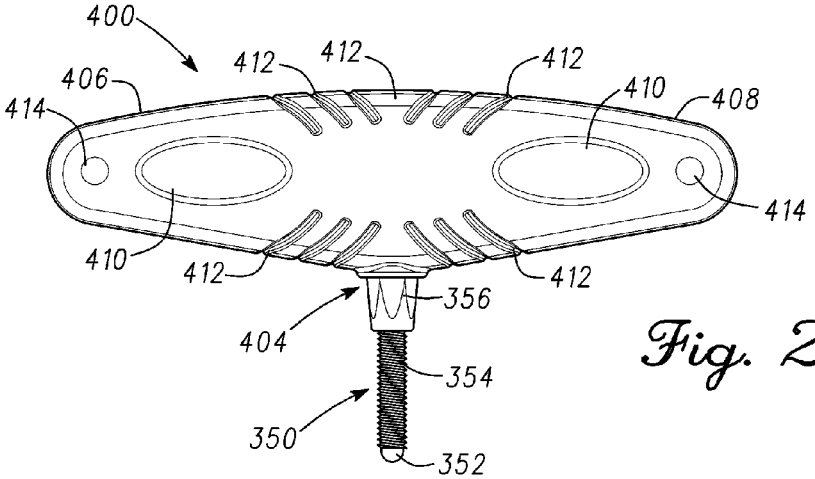

Referring to FIGS. 22-24, a tool 400 for engagement with the bolt 350 according to one example is shown. The tool 400 includes a body 402 having a blind bore 404 (shown in FIG. 23) for receiving the head 356 of the bolt 350. The inner diameter of the bore 404 may be slightly smaller than the outer diameter of the head 356 of the bolt 350 so as to provide press fitting of the head 356 into the bore 404. Alternatively, the bolt 350 and the tool 400 may be co-manufactured so as to be a continuous one-piece part. In yet another alternative, the inner diameter of the bore 404 may be slightly larger than the outer diameter of the head 356 of the bolt 350 so as to provide substantially effortless insertion and removal of the head 356 into and out of the bore 404. The shape of the bore 404 may generally correspond with the shape of the head 356 of the bolt 350. For example, if the head 356 is hex shaped, then the bore 404 may also be hex shaped. Referring back to FIG. 20, the head 356 of the bolt 350 may include a chamfered portion 359 to provide guided insertion of the head 356 in the bore 404. Alternatively or in addition, the bore may include a chamfered inner edge portion (not shown) to provide guided insertion of the head 356 in the bore 404.

The tool 400 includes two opposing handles 406 and 408 that are connected to the body 402. The handles 406 and 408 allow an individual to grab and hold the tool 400. Furthermore, because the handles 406 and 408 extend outwardly from the body 402, each handle 406 or 408 creates a moment arm to allow the individual to turn the bolt 350 with less effort than the effort required turning the bolt 350 without the tool 400. Each handle may include a recess 410 (shown in FIG. 23) on one or both sides thereof for receiving an individual's finger or thumb to provide a better grip when the individual turns the tool 350. The surfaces of the handles 406 and 408 may be textured and/or formed from soft plastic materials to provide a better grip for the individual. For example, the tool 400 may include ribbed surfaces 412 to provide better grip for an individual's palm and/or fingers. The tool 400 may include one or more apertures 414 (shown in FIG. 23) for connecting the tool 400 to a key chain, a clip, a belt, golf bag or other objects or accessories that may be carried by an individual.

The bolt 350 and the tool 400 represent an exemplary embodiment of a bolt and a tool. The apparatus, methods, and articles of manufacture described herein are not limited in this regard. For example, a bolt similar to the bolt 216 of FIG. 14 may be used with the collar 302. Accordingly, a corresponding tool similar to the tool 240 of FIG. 15 may be used to engage the bolt 216. Other configurations of a bolt and a corresponding tool are possible. Thus, the shape of the bolt 350 and the shape of the tool 400 are not limited in any way as long as the head and the tool 400 can engage each other and function as described herein. The tip portion 352, the dimple 357, and/or the second inner surface 308 may be constructed or coated with a low friction material to prevent and/or reduce cosmetic damage to the tip portion 352 and/or the second inner surface 308. In other examples, the bolt 350 and the tool 400 can be constructed in one piece such as to be inseparable. Accordingly, the shaft of the bolt 350 may extend from the body of the tool 400 and be an integral part of the body of the tool 400. The bolt 350 and the tool 400 may be a kit so as to define a wrench assembly for use by an individual to adjust the length of the golf club. The kit may be supplied to the individual with the purchase of a golf club and/or provided separately.

Figure 25:
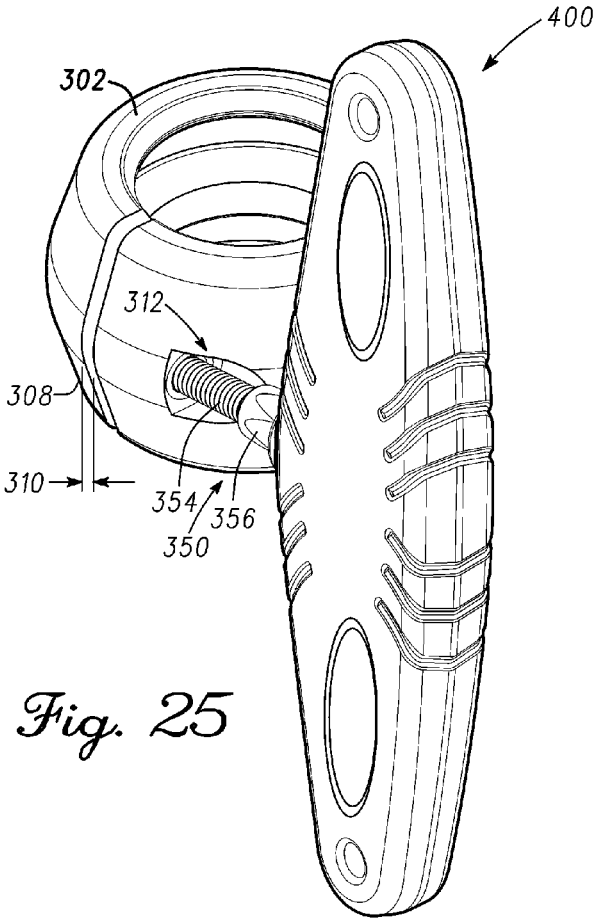
FIG. 25 shows an operation of the collar of FIG. 17 with the fastener of FIG. 20 and the tool of FIGS. 22-24.

Assembling the locking mechanism 300 with the collar 302 will now be described. To assemble the first shaft 112, the second shaft 124 and the locking mechanism 300, the collar 302 may be placed over the first shaft 112. The second end 116 of the first shaft 112 is then inserted into the second shaft 124 as shown in FIG. 7. The collar 302 is then placed over the leaves 142 at the first end 126 of the second shaft 124. Before placing the collar 302 over the leaves 142, the collar 302 may need to be expanded to fit over the leaves 142. Accordingly, the collar 302 can be expanded with the bolt 350 and the tool 400 and slid over the leaves 142. Referring to FIGS. 21 and 25, the collar 302 may include a beveled inner edge 341 to assist in sliding the collar 302 over the leaves 142. When the collar 302 is positioned over the leaves 142, the bolt 350 may be removed from the bore 312 of the collar 302 to close the gap 310, thereby compressing the leaves 142 against the first shaft 112. The compression of the leaves 142 against the collar 302 frictionally locks the first shaft 112 and the second shaft 124 together.

To adjust the length of the golf club 100 by moving the first shaft 112 relative to the second shaft 124, the collar 302 may be expanded. As described above, the bolt 350 is placed in the bore 312 as shown in FIG. 25 and advanced into the bore 312 until the tip portion 352 of the bolt 350 engages the second inner surface 308 or the dimple 357 of the collar 302. The bolt 350 is then further advanced in the bore 312 to further open the gap 310, thereby expanding the collar 302. Accordingly, the compression force of the collar 302 on the leaves 142 is either completely removed or at least partly removed to allow movement between the first shaft 112 and the second shaft 124 by an individual. After the length of the golf club 100 is adjusted, the bolt 350 is withdrawn from the bore 312, thereby allowing the collar 302 to compress the leaves 142 against the first shaft 112. The first shaft 112 and the second shaft 124 are then frictionally locked in the adjusted position.

The first shaft 112 and the second shaft 124 are frictionally locked by default with the locking mechanism 300 since the collar 302 is biased toward an unexpanded position unless expanded with the bolt 350 and the tool 400. Thus, the golf club 100 remains in the locked position by default with the locking mechanism 300. The use of a tool may not be required to adjust the length of the golf club 100. For example, the collar 302 may include a quick-release mechanism, which may be a mechanism by which the collar 302 is quickly moved to the expanded configuration to adjust the length of the golf club 100. A quick-release mechanism is only one example of a tool-less locking mechanisms and the use of other tool-less locking mechanisms are possible. The apparatus, methods, and articles of manufacture described herein are not limited in this regard.

Figure 27:
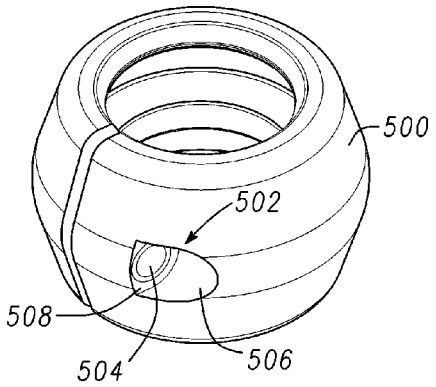
FIG. 27 shows a collar for a locking mechanism of an adjustable length golf club according to another embodiment.

Referring to FIG. 27, a collar 500 for the locking mechanism 300 according to another example is shown. The collar 500 is similar in certain respects to the collar 302 described above. Accordingly, same parts of the collar 500 are referred to with the same reference numbers of the same parts of the collar 302. The collar 500 includes a bore 502 with a first bore section 504 and a second bore section 506. The inner diameter of the first bore section 504 is threaded. The inner diameter of the second bore section 506 is greater than the inner diameter of the first bore section 504. Accordingly, an annular ledge 508 is defined in the bore 502 between the first bore section 504 and the second bore section 506.

Figure 26:
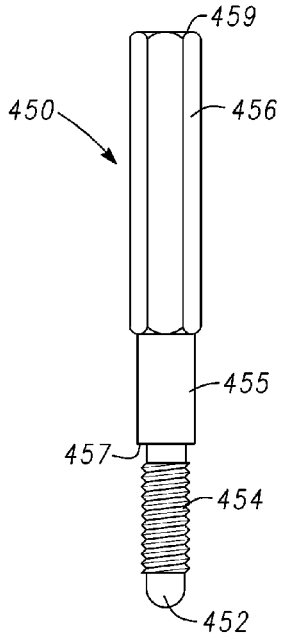
FIG. 26 shows a fastener for a locking mechanism of an adjustable length golf club according to another embodiment.

Referring to FIG. 26, a bolt 450 for use with the collar 500 according to another example is shown. The bolt 450 includes a tip portion 452, a threaded first shaft 454, a second shaft 455, and a head 456. The threaded first shaft 454 is configured to engage corresponding threads of the first bore section 504. The second shaft 455 may be unthreaded and have a larger outer diameter than the first shaft 454. Accordingly, the difference in the outer diameters of the first shaft 454 and the second shaft 455 defines an annular shoulder 457. The diameter of the second shaft 455 is smaller than the diameter of the second bore section 506 so as to be configured to be received in the second bore section 506. The tip portion 452 is unthreaded and may be rounded. The head 456 is configured to allow engagement thereof with a correspondingly configured tool as described below.

Figure 28:
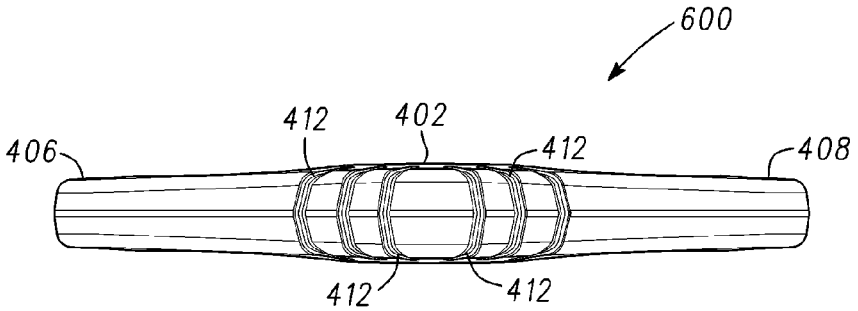
FIGS. 28-30 show a tool and the fastener of FIG. 26 of a locking mechanism of an adjustable length golf club according to another embodiment.
Figure 29:
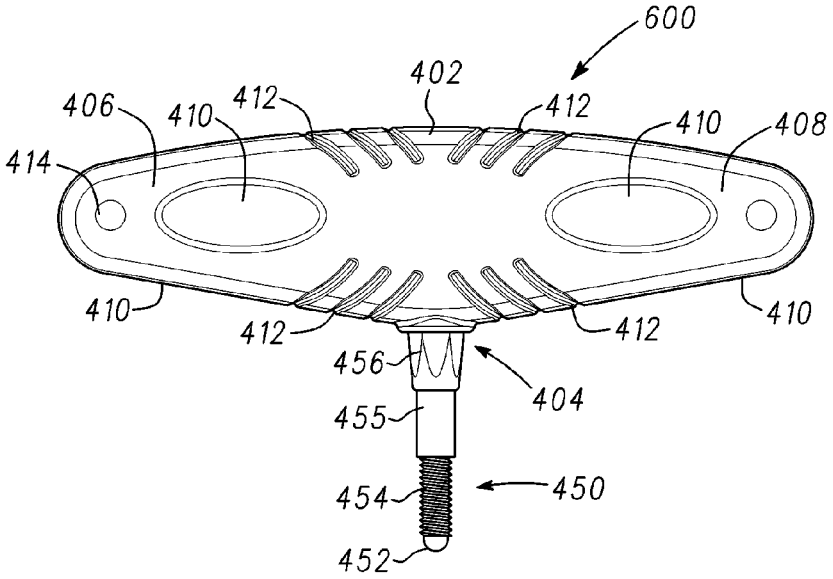
Figure 30:
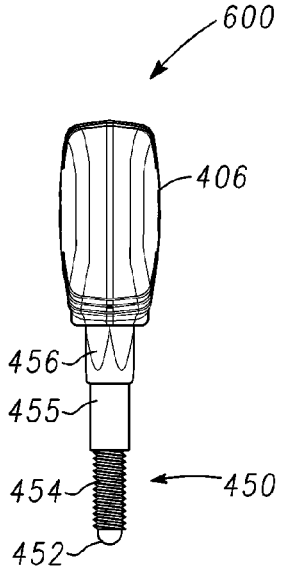

Referring to FIGS. 28-30, a tool 600 for engagement with the bolt 450 according to one example is shown. The tool 600 is similar in certain respects to the tool 400 described above. Accordingly, same parts of the tool 600 are referred to with the same reference numbers of the same parts of the tool 400. The bolt 450 may be press fitted in the bore 404 of the tool 600. Alternatively, the bolt 450 and the tool 600 may be co-manufactured so as to be a continuous one-piece part. In yet another alternative, the inner diameter of the bore 404 may be slightly larger than the outer diameter of the head 456 of the bolt 450 so as to provide substantially effortless insertion and removal of the head 456 in and out of the bore 404. The shape of the bore 404 may generally correspond with the shape of the head 456 of the bolt 450. For example, if the head 456 is hex shaped, then the bore 404 may also be hex shaped. The head 456 may include a chamfered portion 459 to provide guided insertion of the head 456 in the bore 404. Alternatively or in addition, the bore may include a chamfered inner edge portion (not shown) to provide guided insertion of the head 456 in the bore 404.

Assembling the collar 500 with a golf club, such as the golf club 100 and operating the locking mechanism 300 with the collar 500, the bolt 450 and the tool 600 is similar to assembly and operation of the locking mechanism 300 with the collar 302. Operation of the collar 500 with the bolt 450 is similar in certain respects to the operation of the collar 302 with the bolt 350. Accordingly, similar assembly procedures and operations are not repeated herein for brevity. The bolt 450 may be advanced into the bore 502 such that the tip portion 452 contacts and pushes the second inner surface 308 to expand the collar 500. As the first shaft 454 is inserted into the first bore section 504 and screwed therein, the second shaft 455 is also advanced toward or into the second bore section 506. The first shaft 454 may be advanced into the first bore section 504 until the annular shoulder 457 of the bolt 450 engages the annular ledge 508 of the collar 500. Accordingly, the first shaft 454 is prevented from further insertion into the first bore section 504. Therefore, damage to the threads in the first bore section 504 may be prevented, over insertion of the first shaft 454 into the first bore section 504 may be prevented, and/or the depth of insertion of the first shaft 454 into the first bore section 504 may be controlled. Controlling the depth of insertion of the first shaft 454 into the first bore section 504 may also provide control of the amount by which the collar 500 is expanded due to contact between the tip portion 452 and the second inner surface 308.

Figure 31:
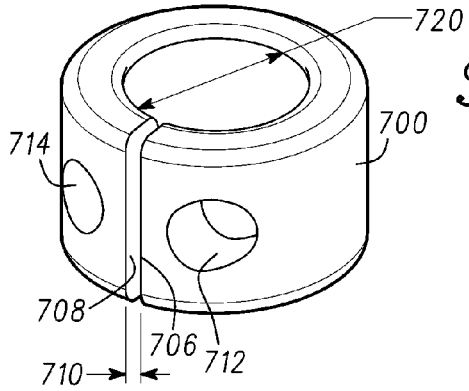
FIG. 31 shows a collar for a locking mechanism of an adjustable length golf club according to another embodiment.

Referring to FIG. 31, a collar 700 for the locking mechanism 300 according to another example is shown. The collar 700 is C-shaped to define a radial gap 710. On one side of the gap 710, the collar 700 includes a first bore 712, which may be a through bore or a blind bore. On the opposite side of the gap 710, the collar 700 includes a second bore 714, which may be a through bore or a blind bore. The bores 712 and 714 may be symmetrically located relative to the gap 710 and may have the same dimensions and/or other bore characteristics. The bores 712 and 714 may be coaxial. The axes of the bores 712 and 714 (not shown) may be parallel or non-parallel.

Figure 32:
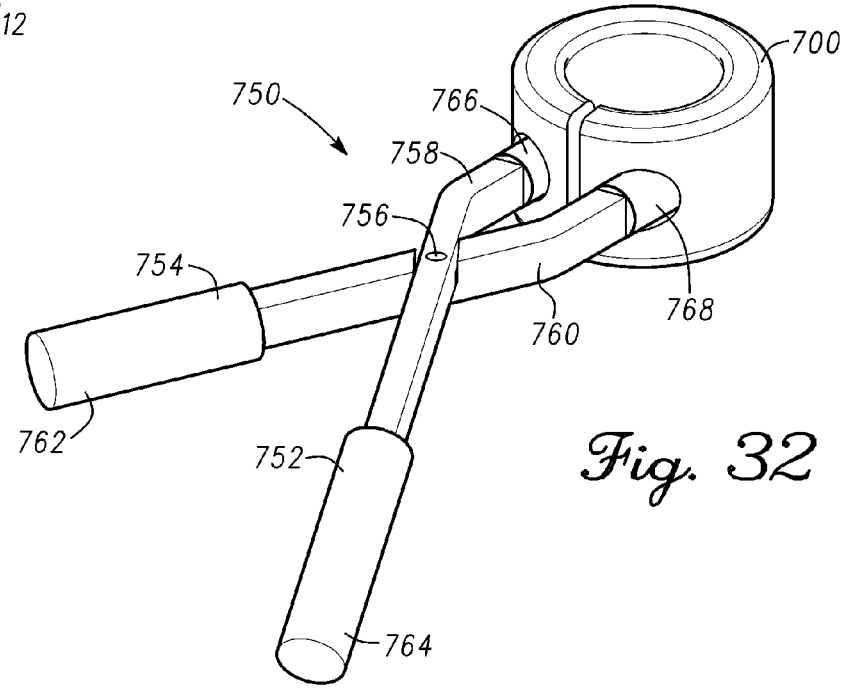
FIG. 32 shows a tool for use with the collar of FIG. 31.

FIG. 32 shows an exemplary tool 750 configured to engage the collar 700 to unlock the collar 700 as described in detail below. The tool 750 includes a first lever 752 and a second lever 754 joined at a fulcrum 756. On one side of the fulcrum 756, the first lever 752 and the second lever 754 define a first jaw 758 and a second jaw 760, respectively. On the opposite side of the fulcrum 756, the first lever 752 and the second lever 754 define a first handle 762 and a second handle 764, respectively. Accordingly, the first handle 762 moves the first jaw 758 and the second handle 764 moves the second jaw 760. Thus, when the first handle 762 and the second handle 764 are moved toward each other, the first jaw 758 and the second jaw 760 move apart, and in contrast, when the first handle 762 and the second handle 764 are moved apart, the first jaw 758 and the second jaw 760 move toward each other. Each the first jaw 758 and the second jaw 760 has a first engagement tip 766 and the second engagement tip 768 that is configured to engage the first bore 712 and the second bore 714, respectively, as described in detail below.

Assembling the locking mechanism 300 with the collar 700 will now be described. To assemble the first shaft 112, the second shaft 124, and the locking mechanism 300, the collar 700 is placed over the first shaft 112. The second end 116 of the first shaft 112 is then inserted into the second shaft 124 as shown in FIG. 7. The collar 700 is then placed over the leaves 142 at the first end 126 of the second shaft 124. Before placing the collar 700 over the leaves 142, the collar 700 may need to be expanded to fit over the leaves 142. Accordingly, the collar 700 can be expanded with the tool 750 and slid over the leaves 142. Referring to FIG. 31, the collar 700 may include a beveled inner edge 722 to assist in sliding the collar 700 over the leaves 142. When the collar 700 is positioned over the leaves 142, the tool 750 may be removed from the collar 700 to close the gap 710, thereby compressing the leaves 142 against the first shaft 112. The compression of the leaves 142 against the collar 700 frictionally locks the first shaft 112 and the second shaft 124 together.

Referring to FIG. 32, to expand the collar 700, the tool 750 is engaged with the collar 700 by the engagement the first engagement tip 766 and the second engagement tip 768 being inserted into the first bore 712 and the second bore 714 of the collar 700, respectively. The first engagement tip 766 and the second engagement tip 768 may be configured to loosely or in a slight frictional manner fit inside the first bore 712 and the second bore 714, respectively. To expand the gap 710 or place the collar 700 in the expanded configuration, the first handle 762 and a second handle 764 are moved toward each other, thereby causing the first jaw 758 and the second jaw 760 to move apart. The first handle 762 and the second handle 764 may be longer than the first jaw 758 and the second jaw 760 to provide leverage at the fulcrum 756 when expanding the gap 710. The extent to which the first handle 762 and the second handle 764 can be moved toward each other may depend on the strength of the person using the tool 750. However, slight movement of the first handle 762 and the second handle 764 toward each other may be sufficient to place the collar 700 in the expanded configuration. After the first shaft 112 and the second shaft 124 are positioned relative to each other to provide a preferred length for the golf club 100, the first handle 762 and a second handle 764 are moved farther apart, thereby moving the first jaw 758 and the second jaw 760 toward each other to place the collar 700 in the unexpanded configuration. Alternatively, the tool 750 can be removed from the collar 700 thereby causing the elasticity of the collar 700 to return the collar 700 to the unexpanded configuration to compresses the leaves 142 against the first shaft 112. The first shaft 112 and the second shaft 124 are then frictionally locked in the adjusted position.

The golf club 100 and the tool 750 may be provided as a package or a kit. The tool 750 may have features that provide easier unlocking and locking operation of the locking mechanism. For example, the tool 750 may have springs or the like between the handles and/or the first jaw 758 and the second jaw 760 to assist in operating the tool 750. The tool 750 may have a locking/release mechanism between the handles, between the jaws and/or at the fulcrum to allow the position of the jaws and/or the handles to be locked/released in any preferred position of the handles and/or the jaws. The tool 750 may be configured so that it operates in an opposite manner to the operation described above. For example, moving the handles toward each other may cause the jaws to move toward each other, and moving the handles away from each other may cause the jaws to move apart. The tool may have a configuration that is very dissimilar to the tool 750 described above. Therefore, the tools described herein represent only examples and any tool that can engage the first bore 712 and the second bore 714 to operate the locking mechanism 300 can be used.

Figure 33:
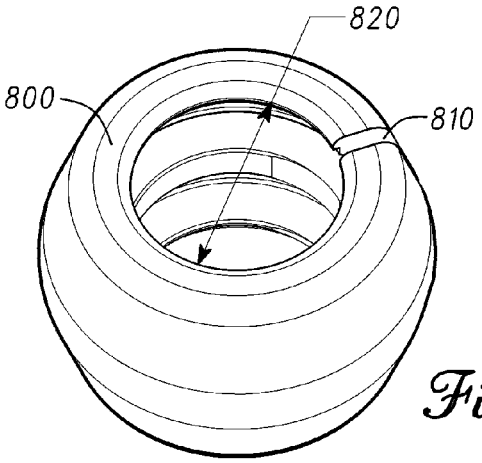
FIG. 33 shows a collar for a locking mechanism of an adjustable length golf club according to another embodiment.
Figure 34:
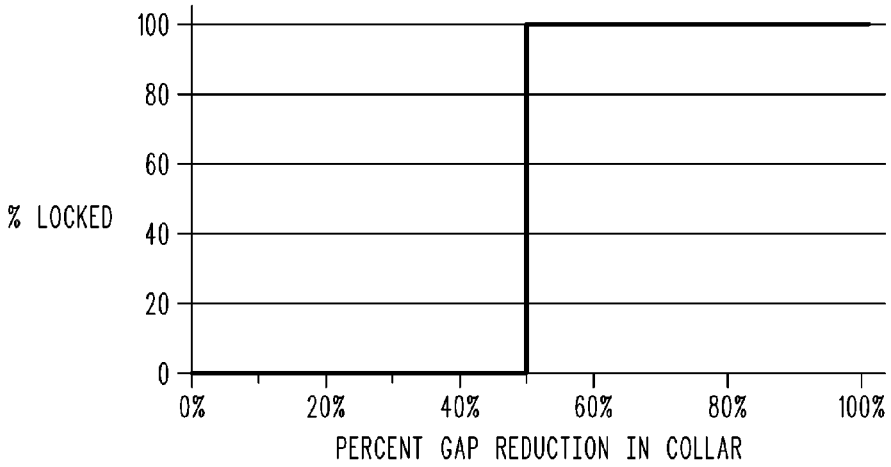
FIG. 34 shows a graph depicting an operation of the collar of FIG. 33.

Referring to FIG. 33, a collar 800 for a locking mechanism according to another example is shown. The collar 800 is generally C-shaped and may have a gap 810 on at least a portion of the collar 800. The locking and unlocking of the collar 800 may directly relate to collar compression, reduction in the gap 810, and/or reduction in the inner diameter 820 of the collar 800. FIG. 34 shows locking status of the collar 800 on the vertical axis as percent locked and on the horizontal axis as percent reduction in the gap 810. FIG. 33 is only an example of a locking mechanism 800 and the data graphically shown in FIG. 34 is merely exemplary and in no way limits the disclosed locking mechanism 800. The collar 800 may remain unlocked or about 0% locked until the reduction in the gap 810 reaches a certain level. In the example of FIG. 34, the collar 800 remains unlocked until the reduction in the gap 810 is about 50%. Upon the reduction in the gap 810 reaching and/or exceeding about 50%, the collar 800 moves to the locked position or becomes about 100% locked. Accordingly, the locking mechanism 800 may progress in a step-function manner between an unlocked position and a locked position. In other words, the collar 800 almost immediately transitions from the unlocked position to the locked position upon reaching a certain collar compression level, a certain reduction in the gap 810, and/or a certain reduction in the collar inner diameter 820. Thus, the collar 800 is moveable between two positions, which are an unlocked position and a locked position. The unlocked position is shown in FIG. 34 by the collar 800 being about 0% locked, while the locked position is shown by the collar 800 being about 100% locked.

The locking of the collar upon reaching a certain collar compression level, a certain level of reduction in the gap 810, or a certain level of reduction in the collar inner diameter 820 may be achieved by any type of fastening, latching and/or locking mechanism that may be self-engaging or engaged by the individual who is adjusting the length of the golf club 100. An example of such a fastening, latching and/or locking mechanism is described below. However, any type of fastening, latching and/or locking mechanism that is separate from the collar 800 or integrally formed on the collar 800 can be used to provide the locking functionality described herein and illustrated in FIGS. 33 and 34.

Figure 35:
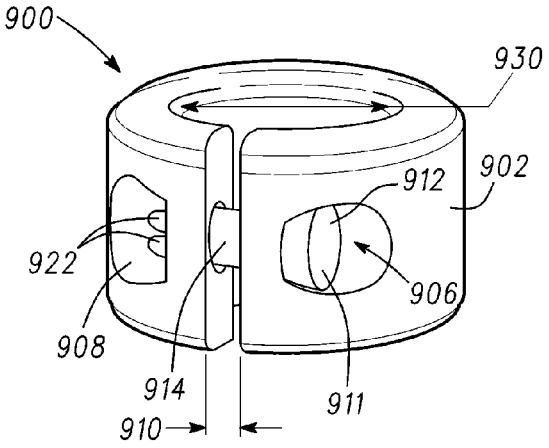
FIGS. 35-36 show a collar and a fastener for a locking mechanism of an adjustable length golf club according to another embodiment.
Figure 36:
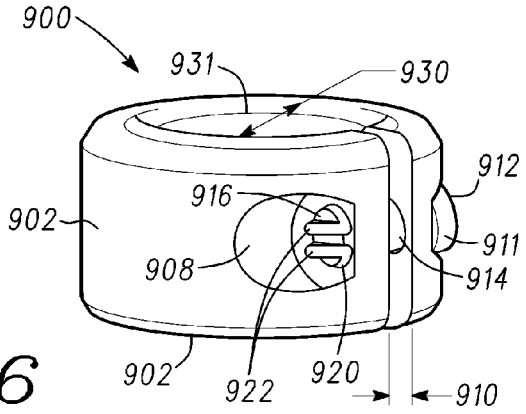

FIGS. 35 and 36 show an example locking mechanism 900 according to another embodiment. The locking mechanism 900 includes a collar 902 which may operate similar to the collar 800 as described above. The locking mechanism 900 also includes a fastening mechanism 904 according to one exemplary embodiment. The collar 902 has a first bore 906 on one side of the collar 902 and a second bore 908 on the opposite side of the collar 902. The first bore 906 and the second bore 908 extend through the collar 902 and open into a gap 910. The bores 906 and 908 may be generally coaxial.

The fastening mechanism 904 includes a rivet 911, which is configured to be received in the bores 906 and 908. The fastening mechanism 900 may also include a tool (not shown) for locking and unlocking the collar 902. The rivet 911 includes a head 912, a shaft 914 and a tip portion 916. At least a portion of the head 912 has a diameter that is greater than the inner diameters of the bores 906 and 908. Accordingly, the head 912 may not be entirely inserted into the bores 906 and 908 so as to pass through the bores 906 and 908. The tip portion 916 includes two prongs 920 that are connected to the shaft 914 and extend coaxially with the shaft 914. Each prong 920 has a wedge portion 922. At the location where the wedge portions 922 meet the shaft 914, the width of the tip portion 916 is greater than the inner diameter of the bores 906 and 908. However, the prongs 920 function similar to leaf springs, in that moving the prongs 920 toward each other creates an elastic restoring force in the prongs 920. Accordingly, inserting the prongs 920 into any one of the bores 906 or 908 causes the inclined edges of each wedge portion 922 to engage the bore 906 or 908 to thereby elastically deflect the prongs 920 toward each other. Thus, by pushing the prongs 920 into any one of the bores 906 or 908, the prongs 920 can be inserted in the bore 906 or 908. However, as soon as the prongs 920 pass through the bore 906 or 908, the prongs 920 snap back to prevent the wedge portions 922 from re-entering the same bore. To re-enter the same bore, the prongs 920 have to be compressed so that the wedge portions 922 move toward each other, thereby allowing the prongs 920 to traverse back through the same bore.

To move the collar 902 to the locked position, a tool (not shown) may be used to compress the collar 902 so as to reduce the gap 910. The tool may be a separate tool or a part of the locking mechanism 902. The rivet 911 is then inserted into the bores 906 and 908 from any one of the first bore 906 or the second bore 908. Assuming that the prongs 920 are first inserted into the first bore 906 and then into the second bore 908, as soon as the prongs 920 traverse through the second bore 908 and exit the second bore 908, the prongs 920 snap back from the deflected position. The wedge portions 922 of the prongs 920 engage the outer surfaces of the collar 800 outside the second bore 908 thereby preventing the prongs 920 from re-entering the bore 908. Accordingly, the collar 902 is maintained in a compressed position by the rivet 911, which corresponds to the locked position of the collar 902. To move the collar 902 to the unlocked position, the wedge portions 922 can be deflected toward each other by hand or with another tool (not shown) or the same tool and pushed through the second bore 908. Once the wedge portions 922 enter the second bore 908, the collar 902 is released from the locked position under the collar's elastic restoring force. Accordingly, the collar 902 moves into the unlocked position. If preferred, the rivet 911 can be removed from the bore 906 similar to the removal from the bore 908 as described above. The tool that is used to compress the collar 902 to move the collar 902 into the locked position may also serve the function of unlocking the collar 902. For example, the tool may have a section for deflecting the wedge portions 922 of the rivet 911 toward each other to allow the wedge portions 922 to pass through any of the bores 906 and 908. The golf club 100 and the tool to move the collar 902 to the locked position and/or the unlocked position may be provided as a package or a kit. The apparatus, methods, and articles of manufacture described herein are not limited in this regard.

The collar 902 may be located or can be placed on the first end 126 of the second shaft 124 such that is surrounds the leaves 142. When the collar 902 is in the unlocked configuration, the inner diameter 930 may be slightly smaller than the outer diameter of the first end 126 of the second shaft 124 defined by the leaves 142. The collar 902 may include a beveled inner edge 931 to assist in sliding the collar 902 over the leaves 142. When the collar 902 is mounted over the first end 126 of the second shaft 124, (i.e., the leaves 142) the elasticity of the collar 902 to causes the collar 902 to slightly compress the leaves 142 against the first shaft 112. However, the frictional engagement between the leaves 142 and the first shaft 112 may not be sufficient in the unlocked position of the collar 902 to prevent the first shaft 112 and the second shaft 124 from moving relative to each other. After an individual adjusts the length of the golf club 100 by moving the first shaft 112 and the second shaft 124 relative to each other, the collar 902 can be moved to the locked position as described in detail above. Accordingly, the individual can compress the collar until the rivet 911 locks the collar, i.e., a certain reduction in the gap 910 is reached according to the example of FIG. 34. In the locked position of the collar 902, compression of the leaves 142 by the compressive force exerted on the leaves 142 with the collar 902 frictionally locks the first shaft 112 and the second shaft 124 together. To again adjust the length of the golf club 100 by moving the first shaft 112 relative to the second shaft 124, the collar 902 may be moved to the unlocked position as described in detail above. The functions and procedures of using the collar 902 to adjust the length of the golf club 100 as described herein are equally applicable to all collars according to the disclosure including collar 902.

Figure 37:
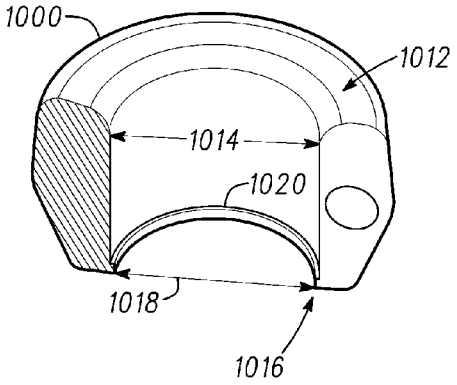
FIGS. 37-38 show a fragmentary view of the collar for a locking mechanism of an adjustable length golf club according to another embodiment.
Figure 38:
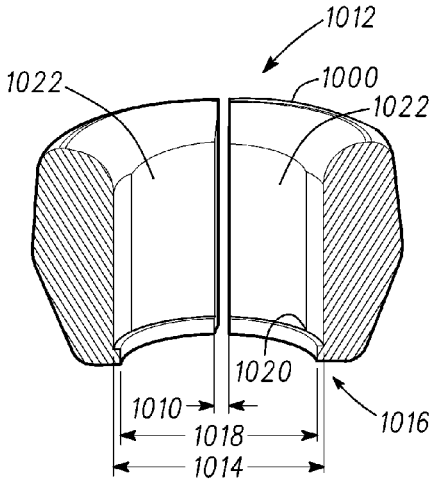

Referring to FIGS. 37 and 38, a collar 1000 according to another exemplary embodiment is shown. The collar 1000 is C-shaped to define a gap 1010. The collar includes a first end 1012 from which the first end section 126 of the second shaft 124 is inserted into the collar 1000. The collar 1000 has a first inner diameter 1014, which generally defines an inner diameter of substantially the entire collar 1000. At a second end 1016, the collar 1000 includes a second inner diameter 1018 which is slightly less than the inner diameter 1014 to define a ledge 1020 at the second end 1016. When the first end 126 of the second shaft 124 is inserted into the collar 1000, the first end 126 engages the ledge 1020, which prevents the first end 126 from traversing beyond the second end 1016 of the collar 1000. In other words, the ledge 1020 functions as a stop for the first end 126 of the second shaft 124 when the second shaft 124 is inserted in the collar 1000.

Referring to FIG. 38, the collar 1000 further includes a recessed section 1022 on each side of the gap 1010. Each of the recessed sections 1022 may be defined as having a larger inner diameter than the inner diameter 1014 of the collar 1000. The recessed sections 1022 may provide placement of the collar 1000 on the first end section 126 of the second shaft 124 without having to substantially expand the collar 1000 from the unexpanded configuration. When the first end 126 of the second shaft 124 is inserted into the collar 1000, the leaves 142 that are located at the first end 126 may slightly compress to conform to the inner diameter 1014 of the collar 1000. However, because of the recessed sections 1022, the leaves 142 may require less compression while entering the collar 1000. Therefore, the recessed sections 1022 may provide easier assembly of the collar 1000 over the leaves 142 of the second shaft 124.

Figure 39:
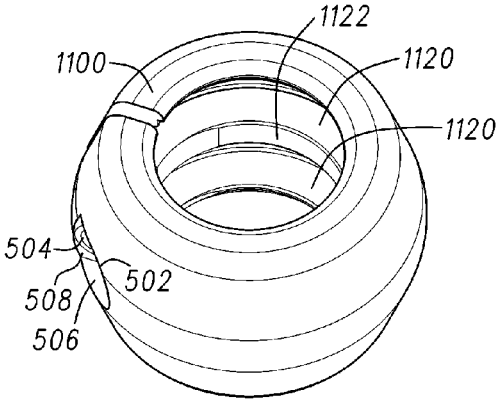
FIGS. 39-40 show a collar for a locking mechanism of an adjustable length golf club according to another embodiment.
Figure 40:
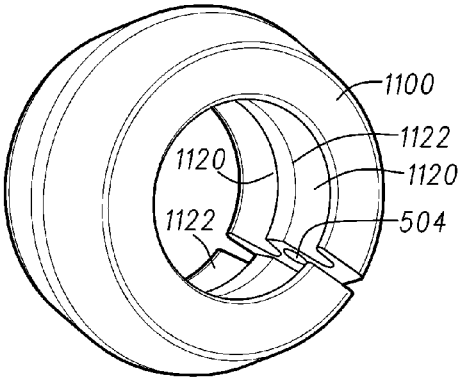

FIGS. 39 and 40 show a collar 1100 according to another exemplary embodiment. The collar 1100 is similar in many respects to the collar 500 of FIG. 27. Accordingly, same parts of the collar 1100 are referred to with the same reference numbers of the same parts of the collar 500. The collar 1100 includes a plurality of inner annular channels 1120 defined by a plurality of inner annular ribs 1122. The channels 1120 defined thin walled sections of the collar 1100, by which the weight of the collar 1100 may be reduced as compared to the collar 500. However, the ribs 1122 may provide sufficient structural strength for the disclosed functions of the collar 1100. As shown in FIGS. 39 and 40, the bore 502, which includes the first bore 504 and the second bore 506, is located along one of the inner annular ribs 1122 so that sufficient structural strength is provided for the bore 502 when a fastener is used with the bore 502. FIGS. 39 and 40 represent one example of reducing the weight of a collar by having the channels formed on the interior of the collar. The channels may be formed by having material being removed from the inner walls of the collar 1100. Accordingly, a collar may be configured to have different channels, dimples, apertures, or other sections from which material is removed to reduce the weight of the collar.

Figure 41:
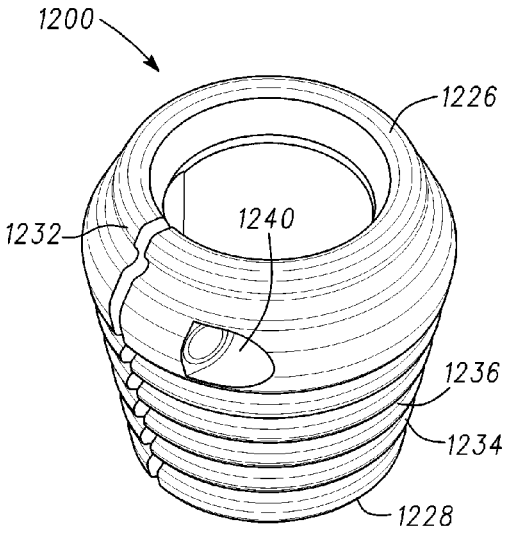
FIGS. 41-42 show a collar for locking mechanism of an adjustable length golf club according to another embodiment.
Figure 42:
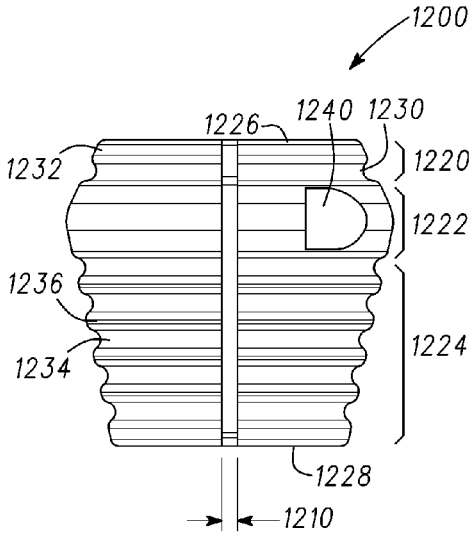

FIGS. 41 and 42 show a collar 1200 according to another exemplary embodiment. The collar 1200 C-shaped and includes a gap 1210. The collar 1200 may include a first section 1220, a second section 1222, and a third section 1224. The first section 1220 extends from a first end 1226 of the collar to the second section 1222. The third section 1224 extends from the second section 1222 to a second end 1228. The first section 1220 and the second section 1224 may be outwardly tapered toward the second section 1222 as shown in FIG. 42. The first section 1220 may include a plurality of external annular channels 1230 defined by a plurality of external annular ribs 1232. In the example of FIGS. 41 and 42, the first section 1220 is shown to have one channel 1230 and one rib 1232. The third section 1224 may also include a plurality of external annular channels 1234 defined by a plurality of external annular ribs 1236. The channels 1230 and 1234 defined thin walled sections of the collar 1200 to reduce the weight of the collar. However, the ribs 1232 and 1236 may provide sufficient structural strength for the disclosed functions of the collar 1200. A bore 1240 is provided in the second section 1222 for receiving a bolt. The second section 1222 is shown not to have any channels and ribs so as to provide a thicker walled section of the collar 1200 for supporting the bore 1240. FIGS. 41 and 42 represent one example of reducing the weight of a collar by having the channels and the ribs formed on the exterior of the collar. The channels may be formed by removed material from the external wall of the collar. Accordingly, a collar may be configured to have different channels, dimples, apertures, or other sections from which material is removed to reduce the weight of the collar.

Figure 43:
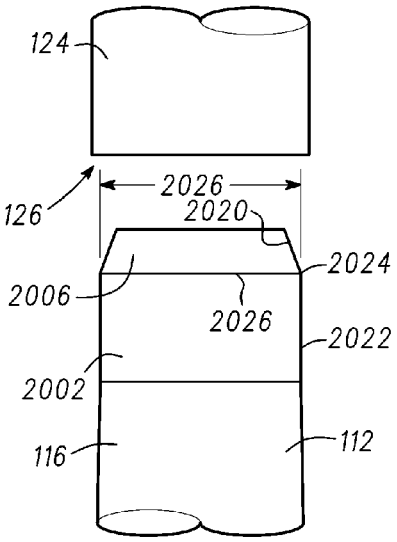
FIGS. 43-45 show a connection mechanism for an adjustable length golf club according to one embodiment.
Figure 45:
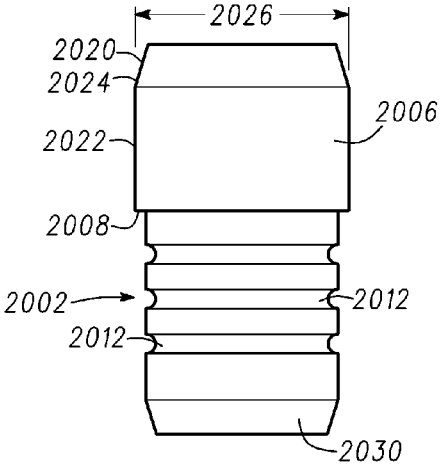
Figure 44:
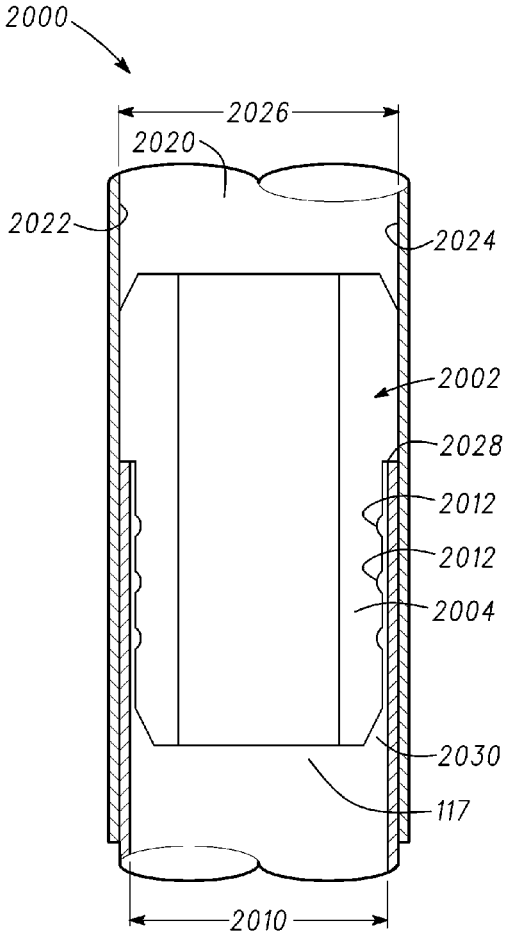

Referring to FIGS. 43-45, a connection mechanism 2000 according to one exemplary embodiment is shown. The connection mechanism 2000 includes an insert 2002 having a first section 2004 and a second section 2006. The first section 2004 may be generally cylindrical having an outer diameter 2010 that may be smaller than the inner diameter 117 of the second end 116 of the first shaft 112. The first section 2004 may be inserted in the second end 116 of the first shaft 112 and secured therein with an adhesive or the like, such as any type of epoxy adhesive. The first section 2004 may include annular grooves 2012 for receiving the adhesive so that sufficient adhesive may be provided between the first section 2004 and the first shaft 112. The grooves 2012 represent only one example of a type of surface structure on the first section 2004. Any type of surface structure such as linear grooves, non-linear grooves, discontinuous grooves, slots, dimples, channels, projections, and/or textures with different patterns may be provided on the first section 2004. Alternatively, the outer diameter 2010 of the first section 2004 may be slightly larger than the inner diameter 117. Accordingly, the first section 2004 may be press fitted inside the first shaft 112 so as to form an interference fit with the first shaft 112. The outer surface of the first section 2004 may include ribs, ridges, projections, and/or a textured surface so as to enhance the interference fit between the first section 2004 and the first shaft 112.

The second section 2006 is generally cylindrical and includes a first tapered portion 2020 and the second tapered portion 2022. Both the first tapered portion 2020 and the second tapered portion 2022 may outwardly taper to a large diameter portion 2024, which may define a larger outer diameter 2026 of the second section 2006. The larger outer diameter 2026 may be greater than the inner diameter 113 of the first end 126 of the second shaft 124. Accordingly, the large diameter portion 2024 provides an interference fit with the first section 126 of the second shaft 124. The outer diameter of the second tapered portion 2022 is greater than the outer diameter of the first section 2004 where the second tapered portion 2022 meets the first section 2004 and is greater than the inner diameter of the second end 116 of the first shaft 112. Accordingly, the transition area between the second tapered portion 2022 and the first section 2004 defines a shoulder 2028.

Referring to FIG. 44, the insert 2002 may be assembled with the first shaft 112 by inserting the first section 2004 into the second end 116 of the first shaft 112 until the shoulder 2028 engages the edge of the second end 116 of the first shaft 112. The shoulder 2028 functions as a stop for the second end 116 of the first shaft 112. During insertion of the first section 2004 into the first shaft 112, a tapered end 2030 of the first section 2004 assists in guiding the first section 2004 into the first shaft 112. As described above, the first section 2004 of the insert 2002 may be secured and the second and 116 of the first shaft 112 with an adhesive or by interference fit. In the assembled configuration of the insert 2002 with the first shaft 112, the insert 2002 and the first shaft 112 may be concentric.

The second shaft 124 may be assembled with the first shaft 112 by inserting the second section 2006 into the first end 126 of the second shaft 124. During insertion of the second section 2006 into the second shaft 124, the first tapered portion 2020 of the second section 2006 assists in guiding the second section 2006 into the second shaft 124 and further assists in compressing the second section 2006 for insertion into the second shaft 124. During assembly, the large diameter portion 2024 engages the inner wall of the second shaft 124 to provide an interference fit with the second shaft 124. In the assembled configuration of the insert 2002 with the second shaft 124, the insert 2002 and the second shaft 124 may be concentric. The interference fit between the second section 2006 and the second shaft 124 compresses the large diameter portion 2024 so that the large diameter portion 2024 exerts a force on the second shaft 124 to maintain the concentricity of the second shaft 124 with respect to the first shaft 112. Accordingly the insert 2002 provide concentric assembly of the first shaft 112 with the second shaft 124. Furthermore, because the large diameter portion 2024 is compressed by an engagement the first section 126 of the second shaft 124, the large diameter portion 2024 is constantly engaged with the first section 126 of the second shaft 124. Therefore, movement and/or vibration between the first shaft 112 and the second shaft 124 may be prevented by the insert 2002 during use of the golf club 100 by an individual (i.e., impact of the golf club 100 with a golf ball).

Figure 46:
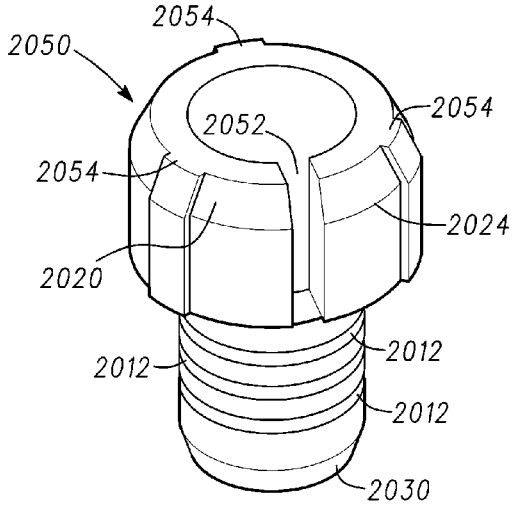
FIGS. 46-47 show a connection mechanism for an adjustable length golf club according to another embodiment.
Figure 47:
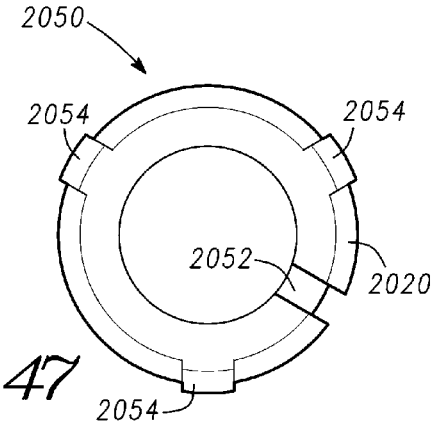

FIGS. 46 and 47 show an insert 2050 according to another example. The insert 2050 is similar in certain aspects to the insert 2002. Therefore, similar parts of the insert 2050 are referred to with the same reference number as the same parts of the insert 2002. The second section 2006 includes a slit 2052 that may allow further compression of the second section 2006 when being inserted into the second shaft 124 as compared to the second section 2006 of the insert 2002. Accordingly, the large outer diameter 2024 of the second section 2006 can be larger in the insert 2050 than the insert 2002. Furthermore, compression of the second section 2006 as a result of having the slit 2052 causes the second section 2006 to press against the inner walls of the second shaft 124 with an elastic restoring force, thereby maintaining constant contact and eccentricity between the second section 2006 and the inner walls of the second shaft 124. Further yet, compression of the second section 2006 as provided by the slit 2052 may provide easier insertion of the second section 2006 into the second shaft 124 by an individual.

Figure 48:
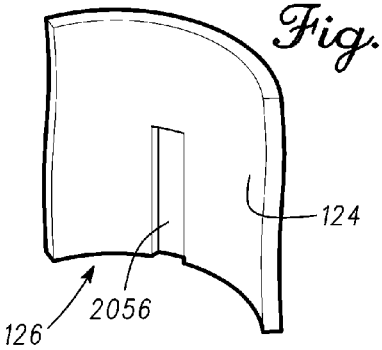
FIG. 48 shows a fragmentary view of an interior of a shaft of a golf club for use with the connection mechanism of FIGS. 46-47.

The second section 2006 of the insert 2050 may further include a plurality of longitudinal ribs 2054. Referring to FIGS. 47 and 48, each rib 2054 is configured to be received in a corresponding slot 2056 inside the first end 126 of the second shaft 124. When the ribs 2054 are engaged in the slots 2056, the insert 2050 is prevented from rotation relative to the second shaft 124. Furthermore, because the first section 2004 of the insert 2050 is affixed to the first shaft 112, engagement of the ribs 2054 in the slots 2056 may also prevent rotation of the second shaft 124 relative to the first shaft 112. When the second section 2006 of the insert 2050 is inserted into the second shaft 124, the ribs 2054 may not readily engage the slots 2056 because the ribs 2054 and the slots 2056 may not have been aligned. However, by rotating the second shaft 124, each rib 2054 will reach a slot 2056 and may snap into the slot 2056 as a result of the elastic force of the second section 2006 being compressed by the second shaft 124. Therefore, after insertion of the second section 2006 into the second shaft 124, rotation of the second shaft 124 relative to the first shaft 112 may cause engagement of the ribs 2054 with the slots 2056 to lock the second shaft 124 relative to the first shaft 112 with respect to rotational motion. The ribs 2054 and the slots 2056 may be in any shape, size and/or configuration as long as each rib 2054 can engage a corresponding slot 2056 and function as disclosed. Engagement of the ribs 2054 with the slots 2056 may further prevent or reduce rotational motion and/or vibration during the use of the golf club 100 by an individual (i.e., when striking a golf ball).

The inserts 2002 and 2050 may be constructed from any material such as plastics, metals, composite materials, wood and/or any artificial or natural materials. According to one example, the inserts 2002 and 2050 may be constructed from Acrylonitrile Butadiene Styrene (ABS). The inserts 2002 and/or 2050 may be formed by stamping (i.e., punching using a machine press or a stamping press, blanking, embossing, bending, flanging, or coining, casting), injection molding, forging, machining or a combination thereof, or other processes used for manufacturing metal, plastic and/or composite parts.

The inserts 2002 and 2050 are described above with respect to the golf club 100, which is configured such that the first shaft 112 is inserted in the second shaft 124. As described above however, the second shaft 124 may be inserted into the first shaft 112 as may be the case with the long putter 104. Accordingly, the order of insertion of the insert 2002 or 2050 into the first shaft 112 and the second shaft 112 may be reversed. In other words, the first section 2004 of the inserts 2002 or 2050 may be inserted in the second shaft 124 and the second section 2006 may be inserted into the first shaft 112. Therefore, depending on the type of golf club used, the inserts 2002 or 2050 may be accordingly used to perform the disclosed functions.

According to one example, the length of a golf club may relate to the headweight of the club. A headweight may be defined as the inertia of the head encountered by an individual when swinging the golf club. Referring to Table 1, adjustment lengths for a standard putter, a belly putter, and a long putter are shown according to ranges of headweights. Thus, an individual may adjust the length of a putter according to its headweight based on the Table 1 or a mathematical equation by which the values in the table of Table 1 are derived. The apparatus, methods, and/or articles of manufacture described herein are not limited in this regard.

TABLE 1

| | Standard Putter | Belly Putter | Long Putter |
|---|---|---|---|
| Adjustable Length Range | 30-40 in (76-102 cm) | 37-47 in (94-120 cm) | 45-55 in (114-140 cm) |
| Headweight Range | 300-400 grams | 350-450 grams | 450-550 grams |

The exemplary locking mechanisms having the collars according to the disclosure may increase the overall weight of a golf club as compared to a similar club without a locking mechanism. The noted increase in weight may be due to addition of the collar and any additional length for the first shaft and/or the second shaft to provide for insertion of one of the shafts into the other shaft. For example, if a collar according to the examples described herein weighs 35 grams, then the weight of a golf club having such a collar may be at least 35 grams greater than a similar non-adjustable golf club. Furthermore, because the first shaft 112 and the second shaft 124 have a telescoping feature as described in detail herein (i.e., one shaft partly nested inside the other shaft), the extra lengths in the first shaft 112 and the second shaft 124 to facilitate the noted telescoping feature may further increase the weight of the golf club in comparison to a similar non-adjustable golf club. Referring to the second shaft 124 as an upper shaft and to the first shaft 112 as a lower shaft, a lower/upper mass ratio may be determined for a golf club according to the disclosure. The lower/upper mass ratio may be referred to herein as mass ratio. To increase the mass ratio of an adjustable length golf club to thereby reduce the overall weight of the golf club and/or to provide an overall weight balance for the golf club, the second shaft 124 and the first shaft 112 may be constructed from the same materials or different materials having different densities or other physical properties as discussed below.

To increase the mass ratio, the mass of the first shaft 112 may be increased and/or the mass of the second shaft 124 may be reduced without affecting the structural and/or functional properties of the golf club. According to one example, both the first shaft 112 and the second shaft 124 may be constructed from the same material. However, the first shaft 112 may have more mass than the second shaft 124. For example, the first shaft 112 may be constructed from a certain type of steel tube having a certain wall section thickness, while the second shaft 124 may be constructed from the same type of steel tube having a thinner wall section. Thus, the mass/length of the first shaft 112 may be greater than the mass/length of the second shaft 124, thereby providing an increase in the mass ratio. In another example, the first shaft 112 may be constructed from a certain type of steel tube having a certain wall section thickness, while the second shaft 124 may be constructed from the same type of steel tube having the generally same wall section thickness, except for a few areas of reduced wall thickness to reduce the mass/length of the second shaft 124 as compared to the first shaft 112. Further, the density and/or volume of the first shaft 112 may be greater than the density and/or volume of the second shaft 124 to increase the mass ratio as well.

According to another example, the first shaft 112 and the second shaft 124 may be constructed from different materials having different masses or overall densities. However, the first shaft 112 may have more mass or have a greater overall density than the second shaft 124. For example, the first shaft 112 may be constructed from steel and the second shaft 124 may be constructed from graphite. Alternatively, the second shaft 124 may be constructed from aluminum, titanium, graphite based or other types of composite materials, metal alloys, wood, a variety of plastic materials and/or a combination of these materials that have a lower density than steel while providing sufficient structural strength. In another example, the first shaft 112 may be constructed from titanium and the second shaft 124 may be constructed from graphite. For example, the first shaft 112 and the second shaft 124 may have a greater mass when constructed from steel than when constructed from graphite. Accordingly, the first shaft 112 may be constructed from steel and the second shaft 124 may be constructed from graphite to increase the mass ratio while possibly also reducing the overall weight of the golf club. The apparatus, methods, and articles of manufacture described herein are not limited in this regard.

According to one example, a collar according to the disclosure may be constructed from the same or different materials to increase the mass ratio. For example, a lower part of the collar may be formed from denser materials than an upper part of the collar. According to another example, the mass of the collar may be increased or decreased depending on the physical properties (i.e., material of construction, dimensions, density, etc.) of the first shaft 112 or the second shaft 124 to increase the mass ratio. For example, based on the position of a collar on an adjustable length golf club according to the disclosure, increasing the mass of the collar may lead to an increased mass ratio and/or a better overall weight balance for the golf club. In contrast, depending on the type of golf club, reducing the mass of the collar may lead to an increased mass ratio and/or a better overall weight balance for the golf club.

Table 2 illustrates examples of mass ratio when constructing the first shaft 112 and/or the second shaft 124 from graphite and/or steel. As shown, when the first shaft 112 is constructed from steel and the second shaft 124 is constructed from graphite, the greatest mass ratio is achieved among the examples shown in Table 2. A putter having both the first shaft 112 and the second shaft 124 constructed from graphite has a lower mass ratio. However, such a putter may have a lower overall weight than the steel/graphite putter. Accordingly, if increasing the mass ratio is more important than reducing the overall weight of the putter, then the first shaft 112 can be constructed from steel and the second shaft 124 can be constructed from graphite. Conversely, if reducing the overall weight of the putter is more important than increasing the mass ratio, then both the first shaft 112 and the second shaft 124 can be constructed from graphite. Alternatively, the first shaft 112 and the second shaft may be constructed from steel to provide the mass ratio illustrated in Table 2. Table 2 shows examples of the effects of material properties on the mass ratio and is not limited to the materials or physical properties shown.

TABLE 2

| | Approximate Mass Ratio | | |
|---|---|---|---|
| | Graphite/Graphite | Steel/Steel | Steel/Graphite |
| Standard Putter | 2.57 | 2.67 | 10.62 |
| Belly Putter | 1.04 | 1.17 | 4.17 |
| Long Putter | 0.90 | 1.20 | 3.61 |

Figure 49:
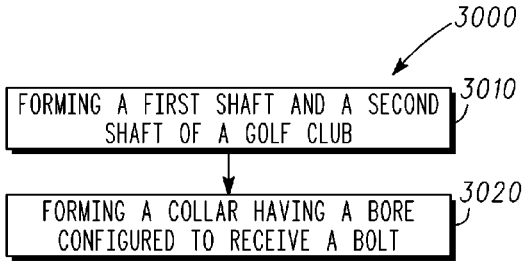
FIG. 49 is a block diagram showing a method of manufacturing a golf club according to one embodiment.

Referring to FIG. 49, an exemplary method 3000 of manufacturing a golf club according to the disclosure is shown. The method 3000 may include forming the first shaft 112 and the second shaft 124 (block 3010). The second shaft 124 may be formed to include a hollow portion configured to movably receive a portion of the first shaft 112. According to the method 3000, a head 120 is attached (not shown in FIG. 49) to the first end 114 of the first shaft 112 and a grip 132 is attached (not show in FIG. 49) to the second shaft 124. With respect to the long putter 104, a second grip 134 may also be attached to the first shaft 112. According to method 3000, a collar such as any of the disclosed collars may be formed (block 3020) to be used for frictionally locking the first shaft 112 and the second shaft 124 as disclosed. Referring to FIG. 27, the collar 500 may be formed (not shown) to include a gap 310. The collar 500 may be formed to further include the first bore section 504 and the second bore section 506 for receiving a bolt such as the bolt 450 of FIG. 26. The second bore section 506 may have a diameter greater than a diameter of the first bore section 504 to define the annular ledge 508. Referring to FIG. 26, the bolt 450 may be formed (not shown in FIG. 49) to include a first bolt section 454 configured to be received in the first bore section 504 and a second bolt section 455 configured to be received in the second bore section 506. The second bolt section 455 may have a greater diameter than a diameter of the first bolt section 454 to define an annular shoulder 457.

The first shaft 112 and/or the second shaft 124 may be constructed from any type of material, such as stainless steel, aluminum, titanium, various other metals or metal alloys, composite materials, natural materials such as wood or stone or artificial materials such as plastic. The first shaft 112 and/or the second shaft 124 may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. For example, a shaft constructed from graphite may be formed by a sheet lamination process, filament winding process or resin transfer molding process. The slits 140 may be cut into the first end 126 of the second shaft 124 after manufacturing the second shaft 124. Alternatively, the end portion 138 may be a separately manufactured part that is attached to the first end 126 of the second shaft 124. The leaves 142 may be manufactured from spring steel, plastic, composite materials, or other materials. Each of the leaves 142 may be a separate piece that is attached to the second shaft 124 or may be co-manufactured with the second shaft 124.

A collar, bolt and/or tool according to the disclosure may be constructed from any metal or metal alloys, plastic, composite materials, wood or a combination thereof. For example, a collar, bolt and/or tool may be constructed from aluminum, steel or titanium. A collar according to the disclosure may include one or more steel helicoils and/or washers in each collar's respective bore for receiving a bolt for prevent loosening of the bolt during use of the golf club 100 by an individual. A collar, bolt and/or tool according to the disclosure may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. A collar according to the disclosure may be in any size or configuration that corresponds to the dimensions and configurations of the first shaft 112 and the second shaft 124 such that the above-described locking function may be performed. The bore of a collar according to the disclosure may have a size 8-32 thread. Accordingly, a bolt according to the disclosure may also be a size 8-32 bolt. A bolt according to the disclosure may have any cross sectional shape such as a hex shape or a Torx shape. In one example, the head of a bolt may be a T20 Torx® head.

Golf standard organizations and/or governing bodies such as the United States Golf Association (USGA) and the Royal and Ancient Golf Club of St. Andrews (R&A) may require certain procedures for adjusting the length of a putter or a golf club during tournament play. For example, some golf standard organizations and/or governing bodies may require that a tool be used to adjust the length of a putter for tournament play. Accordingly, an individual may have to use a tool to adjust the length of a golf club as described above. However, for non-tournament play or if golf standard organizations do not require a tool for length adjustment for tournament play, a collar according to the disclosure may include a quick-release mechanism, which may include an arm having a cam at one end that causes the collar to compress when the arm is rotated from an open position to a closed position. A portion of the arm may be removable from the cam end of the arm so as to function as a tool. Accordingly, the quick-release mechanism may not be locked and/or released without using the removable portion of the arm. Alternatively, the arm may be lockable to the collar 202 in the close position of the arm. According to another example, a locking mechanism may include a threaded compression ring that screws onto the first end 126 of the second shaft 124 to compress the end portion 138 onto the first shaft 112. Other tool-less locking mechanisms that are used to lock two telescoping shafts can be used. Such tool-less mechanisms may also be used during practice on non-tournament play when strict adherence to the rules of golf standard organizations may not be required. The locking mechanism according to the disclosure may include other types of collars, pins, or strapping devices.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An adjustable length golf club comprising:

a first shaft;

a second shaft having a hollow portion configured to movably receive a portion of the first shaft;

a head attached to one of the first shaft or the second shaft;

a grip attached to one of the first shaft or the second shaft, the grip being opposite of the head;

a collar located over the hollow portion of the second shaft such that at least a part of the hollow portion is located inside the collar, the collar having a first side and a second side, the first side and the second side defining a gap, the collar being expandable from a first position to a second position wherein the collar is biased toward the first position, wherein the first position of the collar comprises the collar compressing a portion of the hollow portion of the second shaft against a portion of the first shaft such that the first shaft and the second shaft are frictionally locked, and wherein the second position of the collar comprises the gap being expanded such that the first shaft and the second shaft are movable relative to each other; and a collar expansion member connectable to the collar and configured to expand the collar from the first position toward the second position, a portion of the collar expansion member configured to engage a portion of the collar to limit expansion of the gap.

2. The golf club of claim 1, wherein the collar further comprises a bore extending from the first side to the gap and the collar expansion member comprises a bolt, the bore configured to receive the bolt configured to be advanced into the bore and engage the second side of the collar, wherein the bolt expands the gap when the bolt is further advanced into the bore after engagement of the bolt with the second side of the collar.

3. The golf club of claim 1, wherein the collar comprises an inner ledge portion configured to engage the second shaft to prevent insertion of the second shaft into the collar past the inner ledge portion.

4. The golf club of claim 1, wherein the collar comprises a first inner diameter section defining a first inner diameter of the collar and a second inner diameter section defining a second inner diameter of the collar, and wherein the second inner diameter is greater than the first inner diameter.

5. The golf club of claim 1, wherein at least an inside portion or an outside portion of the collar comprises at least one channel defining a thin walled section of the collar.

6. The golf club of claim 1, wherein the second shaft is lighter than the first shaft.

7. The golf club of claim 1, wherein the first shaft is associated with a first density and the second shaft is associated with second density, the first density being greater than the second density.

8. The golf club of claim 1, wherein the first shaft and the second shaft are constructed from the same material, and wherein the second shaft is constructed such that the second shaft is lighter than the first shaft per unit length.

9. An adjustable length golf club system comprising:

a first shaft;

a second shaft having a hollow portion configured to movably receive a portion of the first shaft, at least a portion of the hollow portion defining a flexible portion being flexible in a direction toward an axis of the second shaft;

a head attached to one of the first shaft or the second shaft;

a grip attached to one of the first shaft or the second shaft, the grip being opposite of the head;

a collar located over the flexible portion of the second shaft such that at least a part of the flexible portion is located inside the collar, the collar having a first side and a second side, the first side and the second side defining a gap, the collar being expandable from a first position to a second position; and a tool separate from the collar and configured to engage the collar to expand the collar from the first position to the second position;

wherein the first position of the collar comprises the collar compressing the flexible portion of the second shaft against a portion of the first shaft located inside the hollow portion of the second shaft such that the first shaft and the second shaft are frictionally locked;

wherein the second position of the collar comprises the gap being expanded such that the first shaft and the second shaft are movable relative to each other; and wherein a portion of the tool is configured to engage a portion of the collar to limit expansion of the gap.

10. The system of claim 9, the flexible portion comprising a portion of the hollow portion of the second shaft having at least one slit to provide flexibility of the flexible portion.

11. The system of claim 9, wherein the tool comprises a bolt, and the collar comprises a bore extending from the first side to the gap, the bore configured to receive the bolt configured to be advanced into the bore and engage the second side of the collar, wherein the bolt expands the gap when the bolt is further advanced into the bore after engagement of the bolt with the second side of the collar.

12. The system of claim 9, wherein the collar comprises an inner ledge portion configured to engage the second shaft to prevent insertion of the second shaft into the collar past the inner ledge portion.

13. The system of claim 9, wherein the collar comprises a first inner diameter section defining a first inner diameter of the collar and a second inner diameter section defining a second inner diameter of the collar, and wherein the second inner diameter is greater than the first inner diameter.

14. The system of claim 9, wherein at least an inside portion or an outside portion of the collar comprises at least one channel defining a thin walled section of the collar.

15. A method of manufacturing a golf club comprising:

forming a first shaft and a second shaft having a hollow portion configured to movably receive a portion of the first shaft, at least a portion of the hollow portion defining a flexible portion being flexible in a direction toward an axis of the second shaft, a head attached to one of the first shaft or the second shaft, and a grip attached to one of the first shaft or the second shaft, the grip being opposite of the head;

forming a collar to be located over the flexible portion of the second shaft such that at least a part of the flexible portion traverses through the collar, the collar having a first side and a second side, the first side and the second side defining a gap, the collar being expandable from a first position to a second position; and forming a tool separate from the collar and configured to engage the collar to expand the collar from the first position to the second position;

wherein the first position of the collar comprises the collar compressing the flexible portion of the second shaft against a portion of the first shaft located inside the hollow portion of the second shaft such that the first shaft and the second shaft are frictionally locked;

wherein the second position of the collar comprises the gap being expanded such that the first shaft and the second shaft are movable relative to each other; and wherein a portion of the tool is configured to engage a portion of the collar to limit expansion of the gap.

16. The method of claim 15, further comprising forming the flexible portion by forming at least one slit in the hollow portion of the second shaft.

17. The method of claim 15, further comprising forming a bore in the collar extending from the first side to the gap, wherein forming the tool comprises forming a bolt configured to be received in the bore and configured to be advanced into the bore and engage the second side of the collar, wherein the bolt expands the gap when the bolt is further advanced into the bore after engagement of the bolt with the second side of the collar.

18. The method of claim 15, wherein forming the collar comprises forming an inner ledge portion for the collar configured to engage the second shaft to prevent insertion of the second shaft into the collar past the inner ledge portion.

19. The method of claim 15, wherein forming the collar comprises forming a first inner diameter section defining a first inner diameter of the collar and forming a second inner diameter section defining a second inner diameter of the collar, and wherein the second inner diameter is greater than the first inner diameter.

20. The method of claim 15, wherein forming the collar comprises forming at least one channel on at least an inside portion or an outside portion the collar defining a thin walled section of the collar.

21. The method of claim 15, wherein forming the first shaft and forming the second shaft comprise forming the second shaft to be lighter than the first shaft.

22. The method of claim 15, wherein forming the first shaft and forming the second shaft comprise forming the first shaft such that the first shaft is associated with a first density and forming the second shaft such that the second shaft is associated with second density, the first density being greater than the second density.

23. The method of claim 15, wherein forming the first shaft and forming the second shaft comprise forming the second shaft such that the second shaft is lighter than the first shaft per unit length, the first shaft and the second shaft being made from the same material.

* * * * *